US009861208B2

(12) United States Patent
Carlitz

(10) Patent No.: US 9,861,208 B2
(45) Date of Patent: Jan. 9, 2018

(54) MULTIFUNCTIONAL MATTRESS SYSTEMS

(71) Applicant: Stuart Carlitz, New Hope, PA (US)

(72) Inventor: Stuart Carlitz, New Hope, PA (US)

(73) Assignee: Mattress Development Company of Delaware, LLC, North Brunswick, NJ (US)

( * ) Notice: Subject to any disclaimer, the term of this patent is extended or adjusted under 35 U.S.C. 154(b) by 0 days.

(21) Appl. No.: 14/299,586

(22) Filed: Jun. 9, 2014

(65) Prior Publication Data

US 2014/0359939 A1 Dec. 11, 2014

(51) Int. Cl.
*A47C 27/08* (2006.01)
*A47C 27/15* (2006.01)

(52) U.S. Cl.
CPC ..... *A47C 27/085* (2013.01); *A47C 27/15* (2013.01); *Y10T 156/1059* (2015.01)

(58) Field of Classification Search
CPC ..... A47C 27/15; A47C 27/085; A47C 27/08; Y10T 156/1059; A47D 15/0018
See application file for complete search history.

(56) References Cited

U.S. PATENT DOCUMENTS 4,047,254 A 9/1977 Hamasu
4,560,714 A * 12/1985 Gajria ..... C08F 220/04 523/409
4,737,998 A * 4/1988 Johnson, Sr. ..... A47C 21/048 5/422
4,862,538 A 9/1989 Spann et al.
4,901,387 A 2/1990 Luke
4,980,940 A 1/1991 Isshiki
5,007,124 A 4/1991 Raburn et al.
5,025,519 A 6/1991 Spann et al.
5,252,278 A 10/1993 Spann et al.
5,362,834 A * 11/1994 Schapel ..... C08G 18/4816 528/58
5,533,218 A 7/1996 Fahy
5,633,286 A * 5/1997 Chen ..... A61C 15/041 132/321

(Continued)

FOREIGN PATENT DOCUMENTS

EP 0068766 A1 6/1982
EP 0265239 A2 10/1987

(Continued)

OTHER PUBLICATIONS

Bedroom Magazine, "Therapedic Introduces GelTouch Mattress Series", http://bedroomretailers.com/mattress-update/therapedic-introduces-geltouch-mattress-series-2/627.

(Continued)

*Primary Examiner* — Robert G Santos
*Assistant Examiner* — Myles A Throop
(74) *Attorney, Agent, or Firm* — Dinsmore & Shohl LLP

(57) ABSTRACT

Embodiments of mattress systems comprise a mattress base, a multifunctional foam layer having a substantially planar top side and a non-planar bottom side contacting a top side of the mattress base, and wherein at least one air passage is present in spacing formed between the top side of the mattress base and the non-planar bottom side of the multifunctional foam layer, and a thermo-regulating gel layer affixed to at least a portion of the top side of the multifunctional foam layer.

19 Claims, 23 Drawing Sheets

(56) References Cited

U.S. PATENT DOCUMENTS

| | | | | |
|---|---|---|---|---|
| 5,671,492 | A | 9/1997 | Simon | |
| 5,802,646 | A | 9/1998 | Stolpmann et al. | |
| 5,815,865 | A | 10/1998 | Washburn et al. | |
| 5,974,609 | A | 11/1999 | Nunez et al. | |
| 6,115,861 | A | 9/2000 | Reeder et al. | |
| 6,212,718 | B1 | 4/2001 | Stolpmann et al. | |
| 6,223,369 | B1 | 5/2001 | Maier et al. | |
| 6,223,371 | B1 | 5/2001 | Antinori et al. | |
| 6,378,152 | B1 | 4/2002 | Washburn et al. | |
| 6,460,209 | B1 | 10/2002 | Reeder et al. | |
| RE38,135 | E | 6/2003 | Stolpmann et al. | |
| 6,677,026 | B1 * | 1/2004 | Yates | A47C 27/085 297/452.41 |
| 6,687,935 | B2 | 2/2004 | Reeder et al. | |
| 6,739,009 | B2 | 5/2004 | del Drago | |
| 6,952,852 | B2 | 10/2005 | Reeder et al. | |
| 7,100,229 | B2 | 9/2006 | O'Reagan | |
| 7,191,483 | B2 | 3/2007 | Hochschild | |
| 7,293,311 | B2 | 11/2007 | Baker | |
| 7,386,903 | B2 | 6/2008 | Hochschild | |
| 7,574,762 | B2 | 8/2009 | Baker | |
| 8,307,482 | B2 | 11/2012 | Gladney et al. | |
| 8,424,137 | B1 * | 4/2013 | Pearce | A47C 27/085 5/630 |
| 2003/0109908 | A1 * | 6/2003 | Lachenbruch | A47C 21/046 607/96 |
| 2004/0074008 | A1 | 4/2004 | Martens et al. | |
| 2004/0098806 | A1 * | 5/2004 | Stender | A47C 7/021 5/654 |
| 2005/0193497 | A1 | 9/2005 | Baker | |
| 2006/0042008 | A1 | 3/2006 | Baker | |
| 2007/0061978 | A1 | 3/2007 | Losio | |
| 2007/0220676 | A1 * | 9/2007 | Lamstein | A01K 1/0157 5/502 |
| 2009/0142551 | A1 * | 6/2009 | Fox | A43B 1/0072 428/158 |
| 2011/0252572 | A1 | 10/2011 | Morrison | |
| 2012/0015151 | A1 * | 1/2012 | Pearce | A47C 27/085 428/156 |
| 2012/0124753 | A1 | 5/2012 | Lee | |
| 2012/0189809 | A1 * | 7/2012 | Henson | B32B 5/18 428/141 |
| 2013/0146211 | A1 * | 6/2013 | Mason | B32B 5/18 156/93 |
| 2014/0109320 | A1 * | 4/2014 | Chunglo | A47C 27/15 5/740 |
| 2014/0208521 | A1 * | 7/2014 | Farnham | A47C 27/144 5/724 |
| 2015/0067967 | A1 * | 3/2015 | Tyree | A47C 27/056 5/691 |

FOREIGN PATENT DOCUMENTS

| | | | |
|---|---|---|---|
| EP | 0367607 | A1 | 11/1989 |
| EP | 0429849 | A2 | 10/1990 |
| EP | 0870449 | A2 | 3/1998 |
| WO | 9719619 | | 6/1997 |
| WO | 9918827 | | 4/1999 |
| WO | 9925225 | | 5/1999 |
| WO | 9929213 | | 6/1999 |
| WO | 9943240 | | 9/1999 |
| WO | 2007003348 | A1 | 1/2007 |
| WO | 2008020885 | A2 | 2/2008 |
| WO | 2014032341 | A1 | 3/2014 |

OTHER PUBLICATIONS

Cuddledown, "Solutions Foam Matress Topper", http://www.cuddledown.com/itemdy00.aspxZt1=Z1140%20102%2014.

Living in comfort.com, "Memory-Pedic Memory Foam Mattress King Size Firm—5 pound—MATMEMPEDS-80", http://www.livingcomfort.com/.

OVERSTOCK.com, "Select Luxury Swirl Gel Memory Foam 8-inch Queen-size Medium Firm Mattress", http://www.overstock.com/Home-Garden/Select-Luxury-Swirl-Gel-Memory-Foam-8-inch-Queen-size-Medium-Firm-Mattress/6455753/product.html.

Allergy Control Products, "Foam Mattress Topper—3.5" GeoMatt", http://www.allergycontrol.com/p-354-foam-mattress-topper-35-geomatt.aspx#tab-description.

geomatt.com, "GeoMattress", httplgeomatt.com/geomattress.htm.

* cited by examiner

MULTIFUNCTIONAL MATTRESS SYSTEMS

CROSS-REFERENCE TO RELATED APPLICATIONS

This application claims priority to U.S. Provisional Application Ser. No. 61/832,337 filed Jun. 7, 2013, and is incorporated by reference herein in its entirety.

BACKGROUND

The present application generally relates to mattresses, and, more particularly mattresses which achieve improved pressure and temperature regulation as well as improved air circulation.

SUMMARY

The quality of sleep is directly correlated to the quality of waking life. Therefore, as one can imagine, a mattress can indirectly affect the quality of waking life by directly impacting the quality of sleep obtained.

Continual issues which plague mattresses and affect sleep are a mattress's ability to regulate temperature and air flow, and its ability to reduce pressure points. Unfortunately, a mattress layer, such as visco-elastic memory foam, which contours well to a person's body, is generally poor at circulating air through the mattress. Additionally, visco-elastic memory foam is temperature sensitive, so a person's body heat may raise the temperature level of the visco-elastic memory foam, and thereby make the mattress uncomfortable for the person. Poor thermal regulation may be highly undesirable in burn units of hospitals. Unfortunately, to achieve increased thermal regulation, there is a sacrifice in firmness or the customizability of firmness within the mattress, which can lead to increased pressure points for a patient. For bedridden patients susceptible to bedsores, this sacrifice in firmness is also unacceptable.

Embodiments of the present disclosure are directed to achieving increased thermal regulation, and increased air flow, while also reducing pressure points. The mattress system has a mattress base, and a multifunctional foam layer having a planar side and a non-planar side. In various embodiments, the non-planar side (or shaped side) contacts a foam layer or the mattress base. Specifically, the non-planar side may define a plurality of bumps or peaks, which allow spacing between the non-planar side and adjacent its contacting layer. This spacing produces at least one air passage, thereby facilitating improved air circulation in the mattress. Moreover, the spacing between bumps or peaks may increase how the foam conforms to the contours to the body, thereby reducing pressure points to person. Furthermore, the mattress system comprises a thermo-regulating gel layer or a gel infused foam layer which regulates the temperature of the mattress system and maintains a "cool" feel for the patient. As a result of the improved thermal and pressure regulation as well increased air circulation, the mattress system embodiments disclosed herein are well suited for home use as well as for use in specialized settings such as hospitals, burn units, and other medical treatment centers, and especially by sufferers of chronic pain, bed sores and the like.

According to one embodiment, a mattress system is provided. The mattress system comprises a mattress base, a support layer disposed over the mattress base, a multifunctional foam layer having a substantially planar top side and a non-planar bottom side contacting a top side of the support layer, and wherein at least one air passage is present in spacing formed between the top side of the support layer and the non-planar bottom side of the multifunctional foam layer, and a thermo-regulating gel layer affixed to at least a portion of the top side of the multifunctional foam layer.

According to another embodiment, the mattress system comprises a mattress base, a multifunctional foam layer having a substantially planar top side and a non-planar bottom side contacting a top side of the mattress base, and wherein at least one air passage is present in spacing formed between the top side of the mattress base and the non-planar bottom side of the multifunctional foam layer, and a thermo-regulating gel layer affixed to at least a portion of the top side of the multifunctional foam layer.

In a further embodiment, a method of making a gel laminated convoluted foam is provided. The method comprises splitting a foam sheet into two interlocked convoluted sheets by feeding the foam sheet to a foam convoluter machine, and adhering a thermo-regulating gel layer on planar surfaces of the convoluted sheets opposite a convoluted profile defined by the convoluted sheets.

According to yet another embodiment, a mattress system comprises a mattress base, at least one channeled foam layer directly overlying the mattress base, wherein the channeled foam layer includes horizontal channels, vertical channels, square sections formed by intersecting horizontal and vertical channels, and combinations thereof. The mattress system further comprises at least one gel infused foam layer disposed over the channeled foam layer, the gel infused foam layer further comprising a heterogeneous mixture of a non-particulate gel and a non-particulate polyurethane foam, the gel infused foam layer being substantially free of visco-elastic memory foam.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

Figure 1:
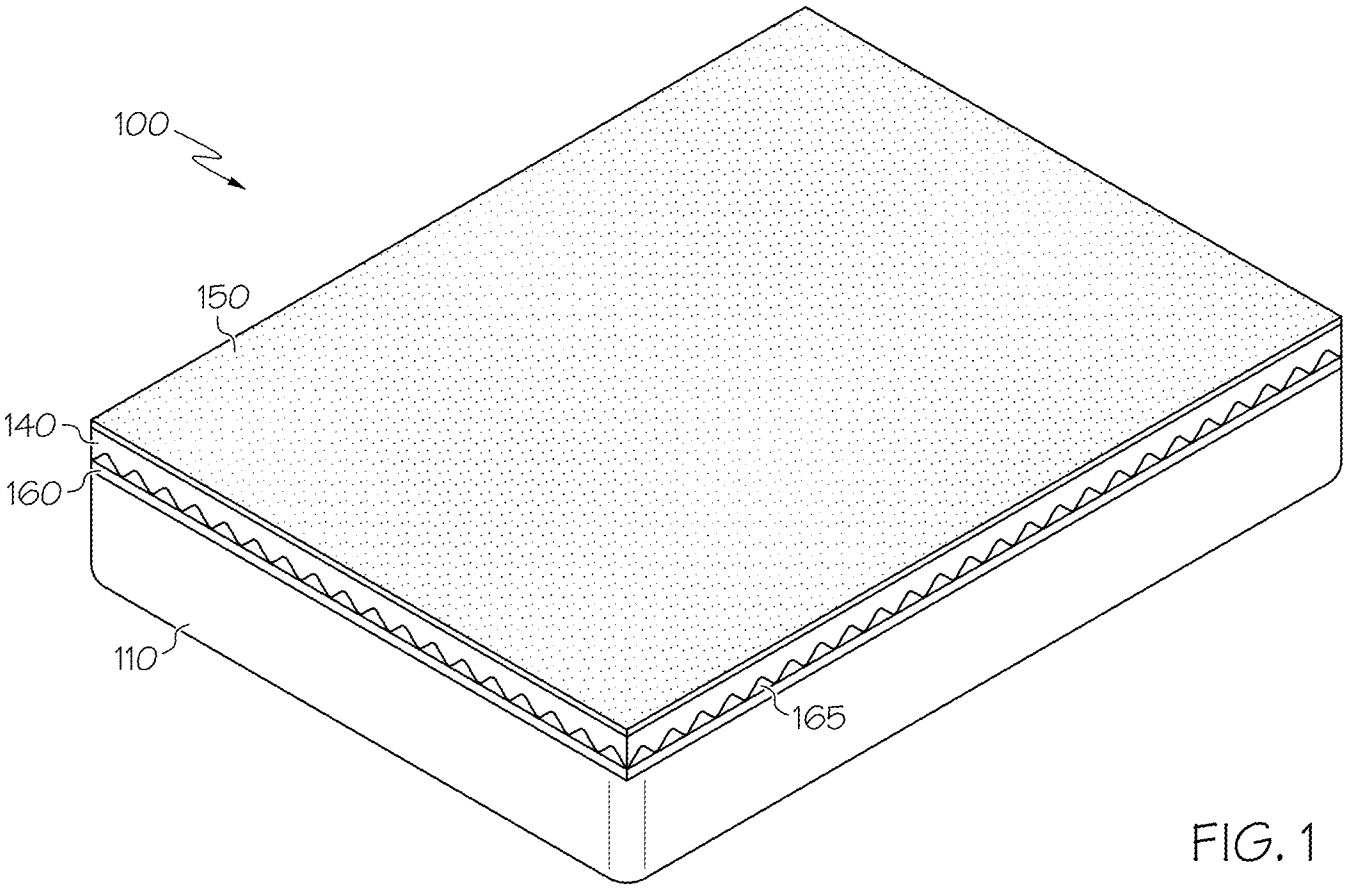
FIG. 1 depicts a multi-layered mattress system having a gel layer attached to a convoluted foam layer disposed over a support layer according to one or more embodiments.

Having provided an overview of several embodiments, reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications and equivalents.

DETAILED DESCRIPTION

Figure 2:
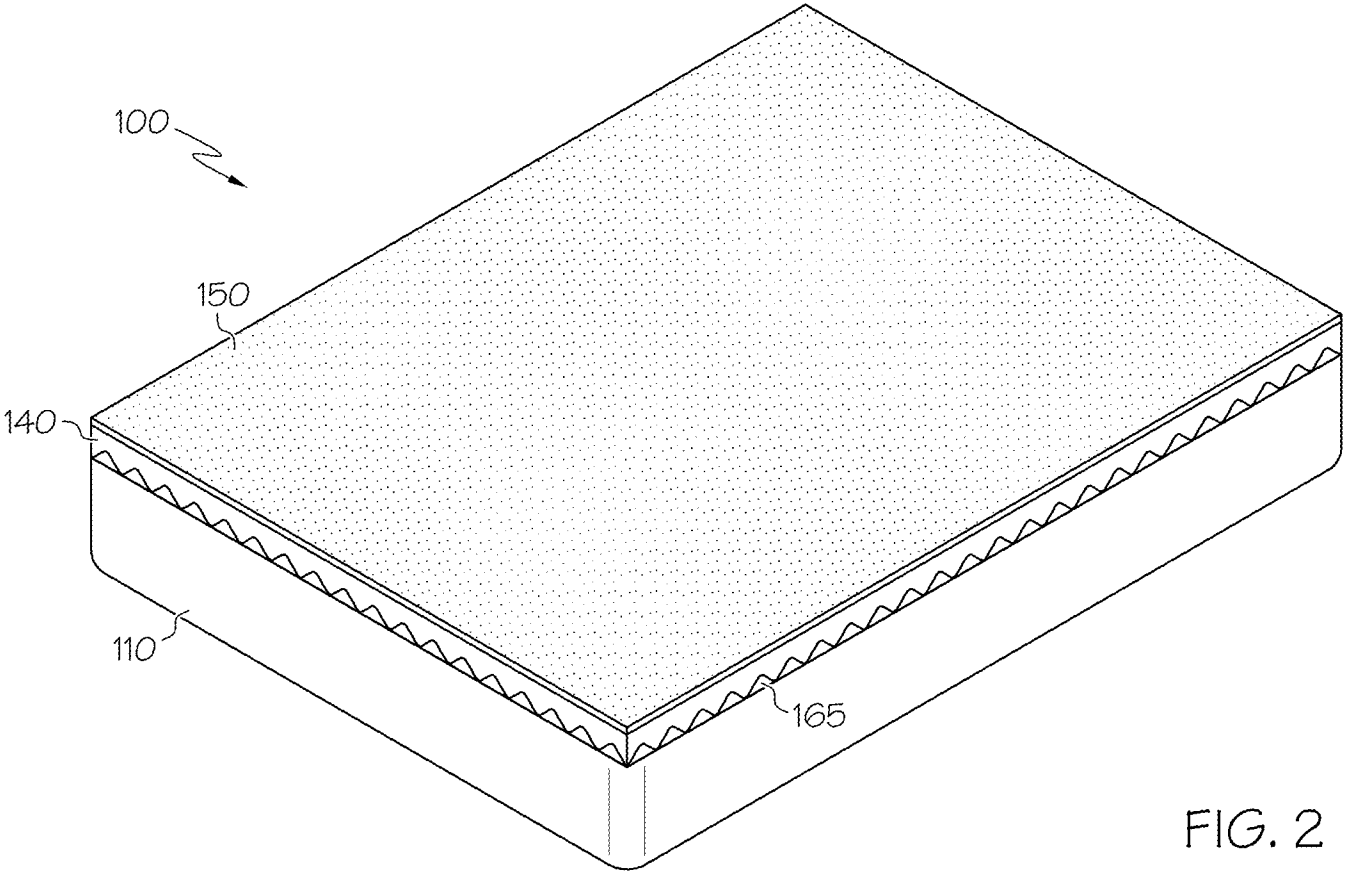
FIG. 2 depicts a multi-layered mattress system having a gel layer attached to a convoluted foam layer disposed over a mattress base according to one or more embodiments.

Referring to the mattress system embodiments of FIGS. 1 and 2, the mattress system 100 comprises a mattress base 110. For example and not by way of limitation, mattress base 110 may comprises one or more components selected from the group consisting of high density foam, springs, filled bladders, coils, wood slats, and combinations thereof. Referring again to FIG. 1, the mattress system 100 may comprise a support layer 160, and a multifunctional foam layer 140 having a substantially planar top side and a non-planar bottom side contacting a top side of the support layer 160. The support layer 160 may work in tandem with the non-planar side of the multifunctional foam layer 140 to yield a mattress which contours better to the body.

While the support layer 160 is depicted in FIG. 1, it is contemplated that the multifunctional foam layer 140 may directly overly the mattress base 110 as shown in FIG. 2, and thereby work in tandem with one of the components of the mattress base 110 to provide increased contouring and reduced pressure points to a person.

As shown in FIG. 1, at least one air passage 165 is formed in the spacing between the top side of the support layer 160 and the non-planar bottom side of the multifunctional foam layer 140. This desirably increases airflow in the mattress system. As used herein, the foam layer 140 is deemed as "multifunctional" because it reduces pressure points and increases air circulation and further can regulate heat upon affixation of the a thermo-regulating gel layer 150 on at least a portion of the top side of the multifunctional foam layer 140. Affixing may be achieved by adhering using an adhesive or other attachment means familiar to the skilled person. As used herein, "thermo-regulating gel" layers are layers which disperse body heat away from the body when it is in contact with the gel layer, thereby achieving this cool feel.

Figure 3:
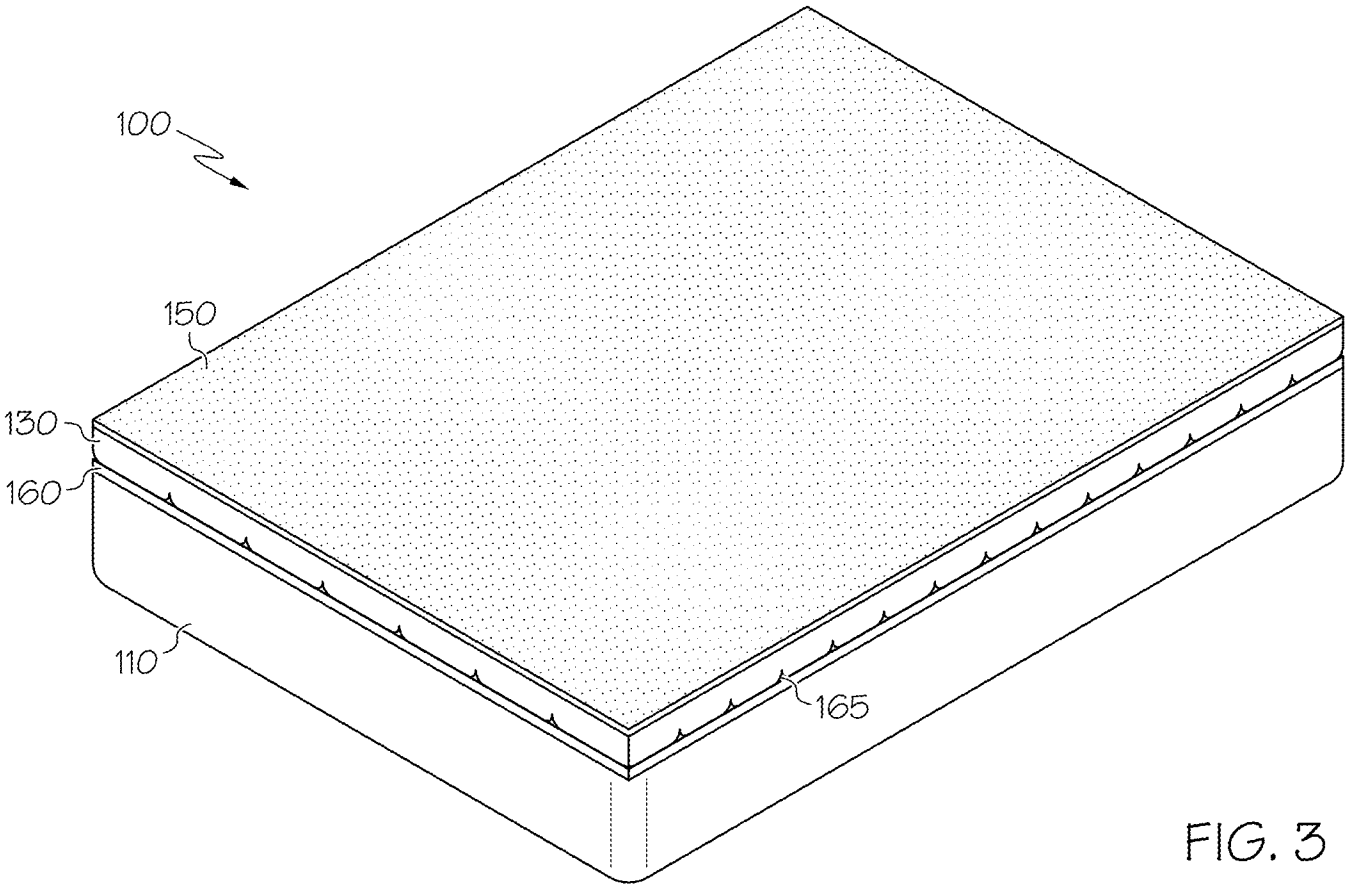
FIG. 3 depicts a multi-layered mattress system having a gel layer attached to a channeled modular foam layer disposed over a support layer according to one or more embodiments.
Figure 4:
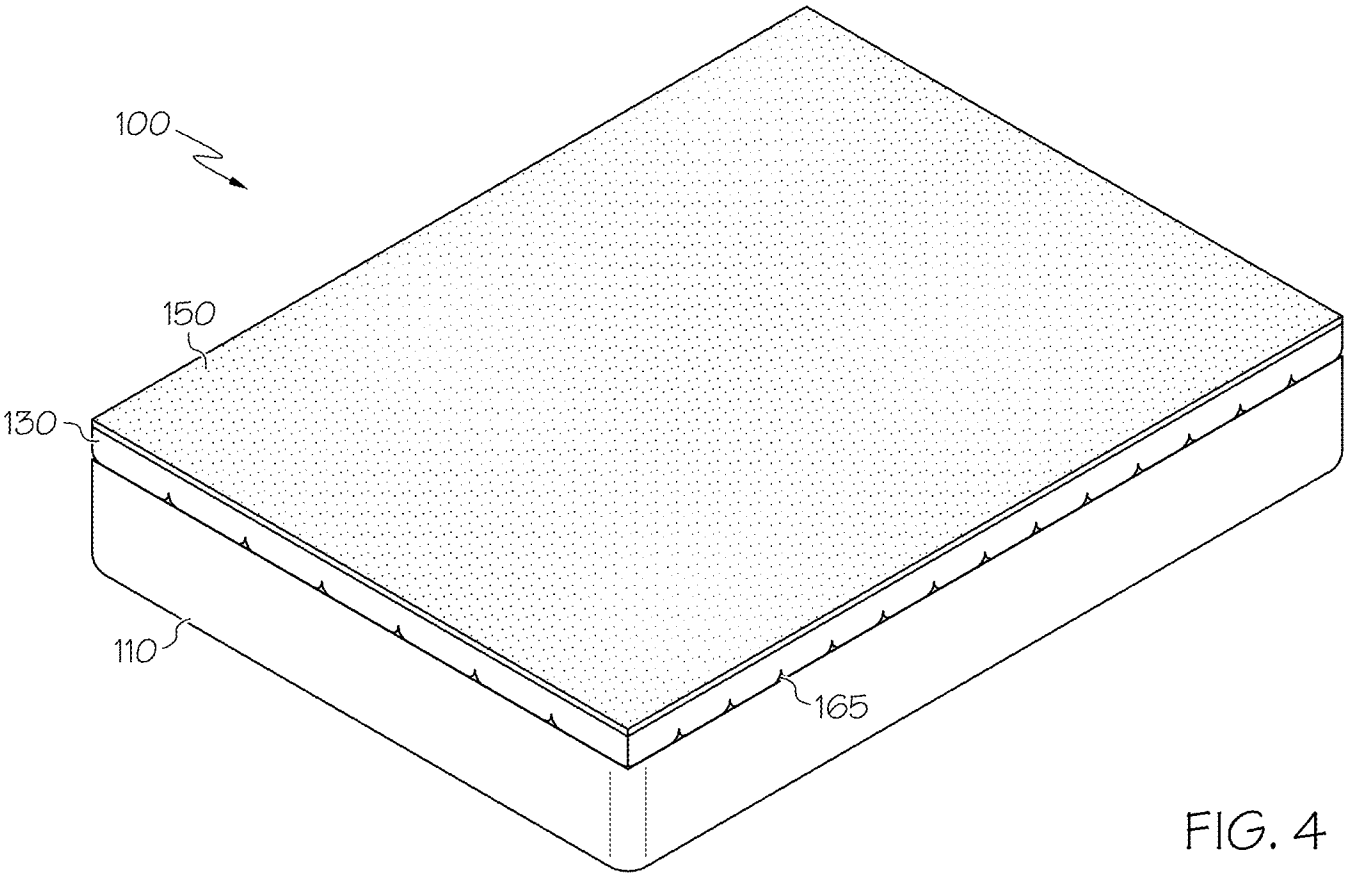
FIG. 4 depicts a multi-layered mattress system having a gel layer attached to a channeled modular foam layer disposed over a mattress base according to one or more embodiments.
Figure 5A:
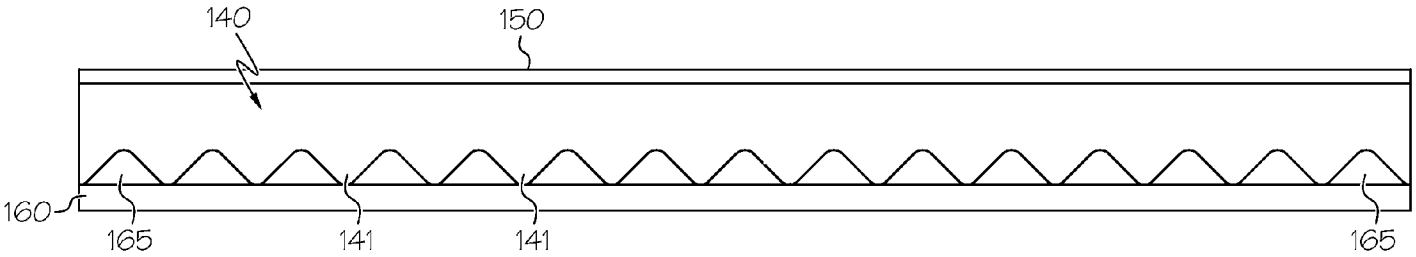
FIG. 5A is a side cross-sectional view depicting a multi-layered mattress system having a gel layer attached to a convoluted foam layer according to one or more embodiments.
Figure 5B:
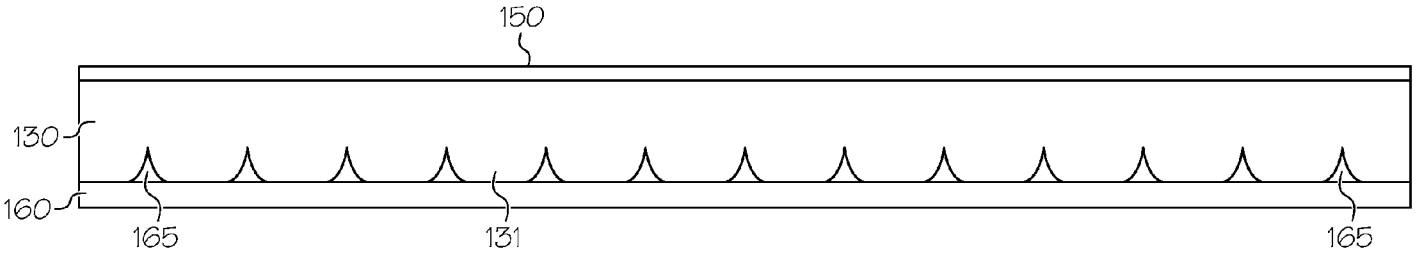
FIG. 5B is a side cross-sectional view depicting a multi-layered mattress system having a gel layer attached to a channeled foam layer according to one or more embodiments.
Figure 6:
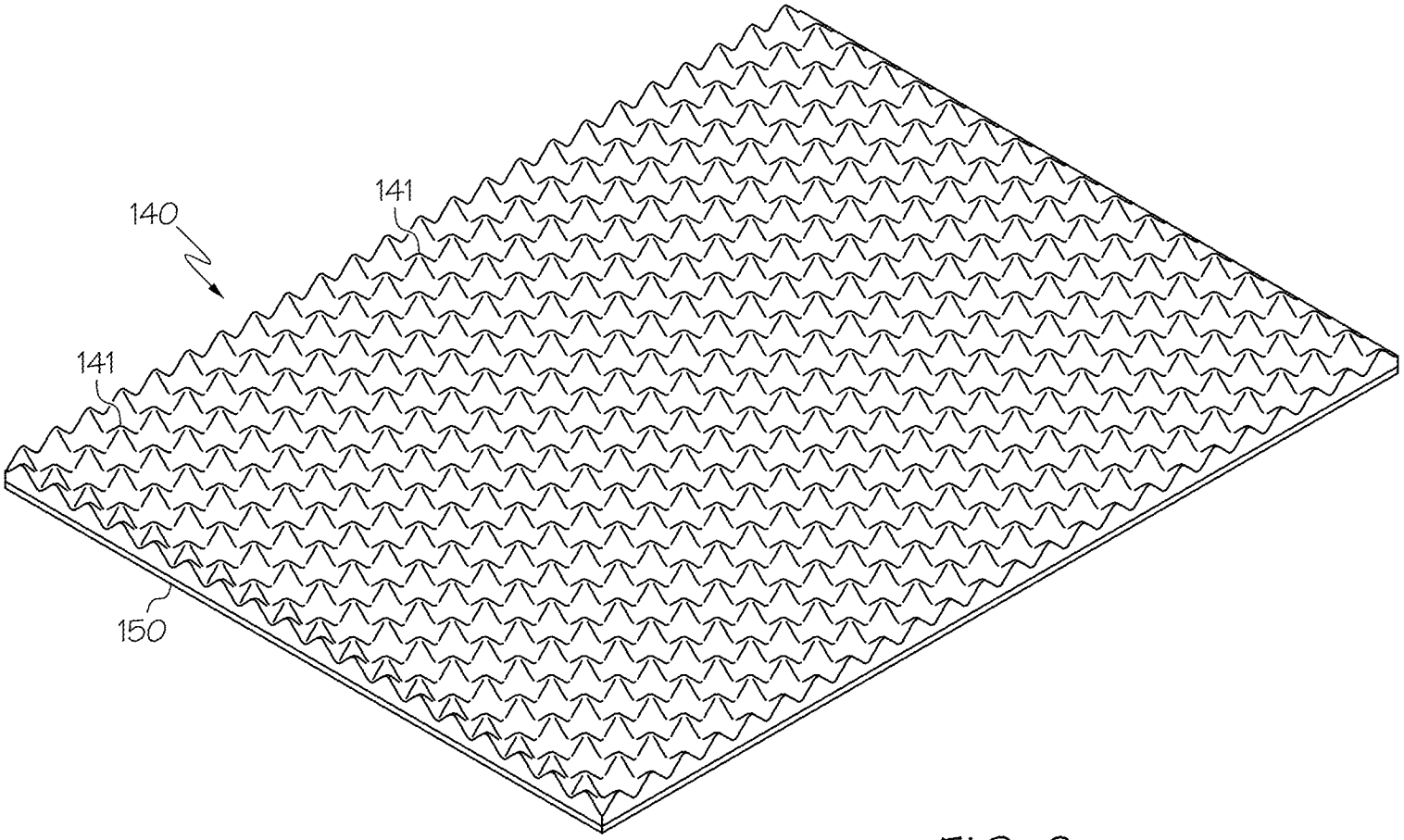
FIG. 6 depicts a convoluted foam layer according to one or more embodiments.

Various profiles are contemplated for the non-planar side of the multifunctional foam layer 140. For example, the non-planar bottom side of the multifunctional foam layer may include a plurality of surface bumps or peaks. These surface bumps or peaks may have the same geometry or a varying geometry across the surface. Referring to FIGS. 1, 2 and 5A, the non-planar side may have a convoluted profile, which as shown in the embodiment of FIG. 5A may be considered an "egg crate" profile with multiple peaks 141. Alternatively as shown in FIGS. 3, 4, and 5B, the non-planar side may define a channeled profile as further depicted in FIGS. 8-16B. Referring to FIG. 5B, the channeled profile may include bumps 131 (also called modules). The profile of the non-planar side is customizable and could include combinations of geometries, for example, a convoluted section and a channeled section.

Various foams are contemplated for the multifunctional foam layer (or layers in alternative contemplated embodiments). For example, the multifunctional foam layer may comprise latex foam, polyurethane foam, visco-elastic memory foam, or another type of high density foam. In specific embodiments, visco-elastic memory foam may be used to further contour to the patient and reduce pressure points. Without being bound by theory, the body contouring achieved by the convoluted or channeled profile may be even further enhanced with the memory foam, which provides significant reduction in pressure points to the user. Additionally, the support layer 160 may also include the above mentioned foams.

Various embodiments are also contemplated for the thermo-regulating gel layer 150. In one embodiment, the thermo-regulating gel layer 150 is an aqueous polymeric gel. The aqueous polymeric gel may be produced from acrylic monomer. In yet another embodiment, the thermo-regulating gel layer 150 is a polyurethane gel. Suitable commercial embodiments of the thermo-regulating gel layer 150 may be the Hydrogel product manufactured by Gel Industry S.r.l. As shown in the drawings, the thermo-regulating gel layer 150 may extend across the entirety of the multifunctional foam layer 140; however, it is contemplated that only partial sections or zones of the multifunctional foam layer 140 are covered with the thermo-regulating gel.

While not shown, the mattress system 100 may further comprise a quilted cover over the thermo-regulating gel layer 150. To ensure the person receives the "cool" feel delivered by the thermo-regulating gel layer 150, the lying person must be in close proximity to the thermo-regulating gel layer 150. Thus, it is desirable that very few layers, if any, such as a quilted cover, are placed over the thermo-regulating gel layer 150.

Figure 7:
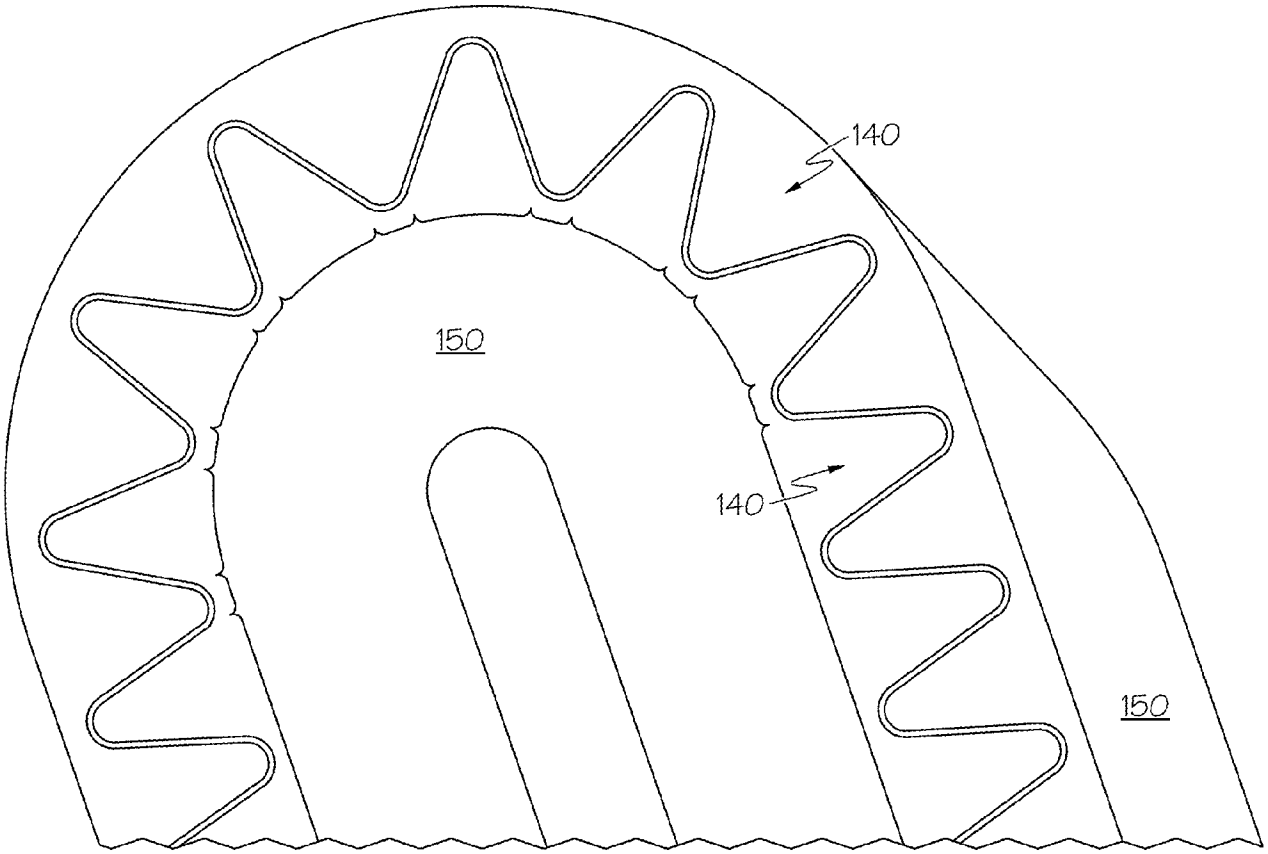
FIG. 7 depicts a convoluted foam layer according to one or more embodiments.

Referring to FIG. 7, the convoluted foam layer may be produced by feeding a foam layer through a foam convoluter machine, which yields two interlocked egg crate sheets as depicted in FIG. 7. Then, the two convoluted sheets have the thermo-regulating gel layer 150 affixed to the two planar non-convoluted sides. It is also contemplated that the gel layer could be adhered, affixed or laminated prior to feeding to the convoluter machine.

Alternative embodiments of the mattress system as depicted in FIGS. 8-16B are directed to infusing a gel into a foam layer and optional combining with channeled foam layer. As shown in these additional embodiments, the channeled foam layers may face upward towards the person whereas the channeled foam of FIGS. 3-4 face way from the person. Both configurations contour to the human body well and reduce pressure points; however, further comfort is noted when the bumps or peaks extend away from the person.

Figure 8:
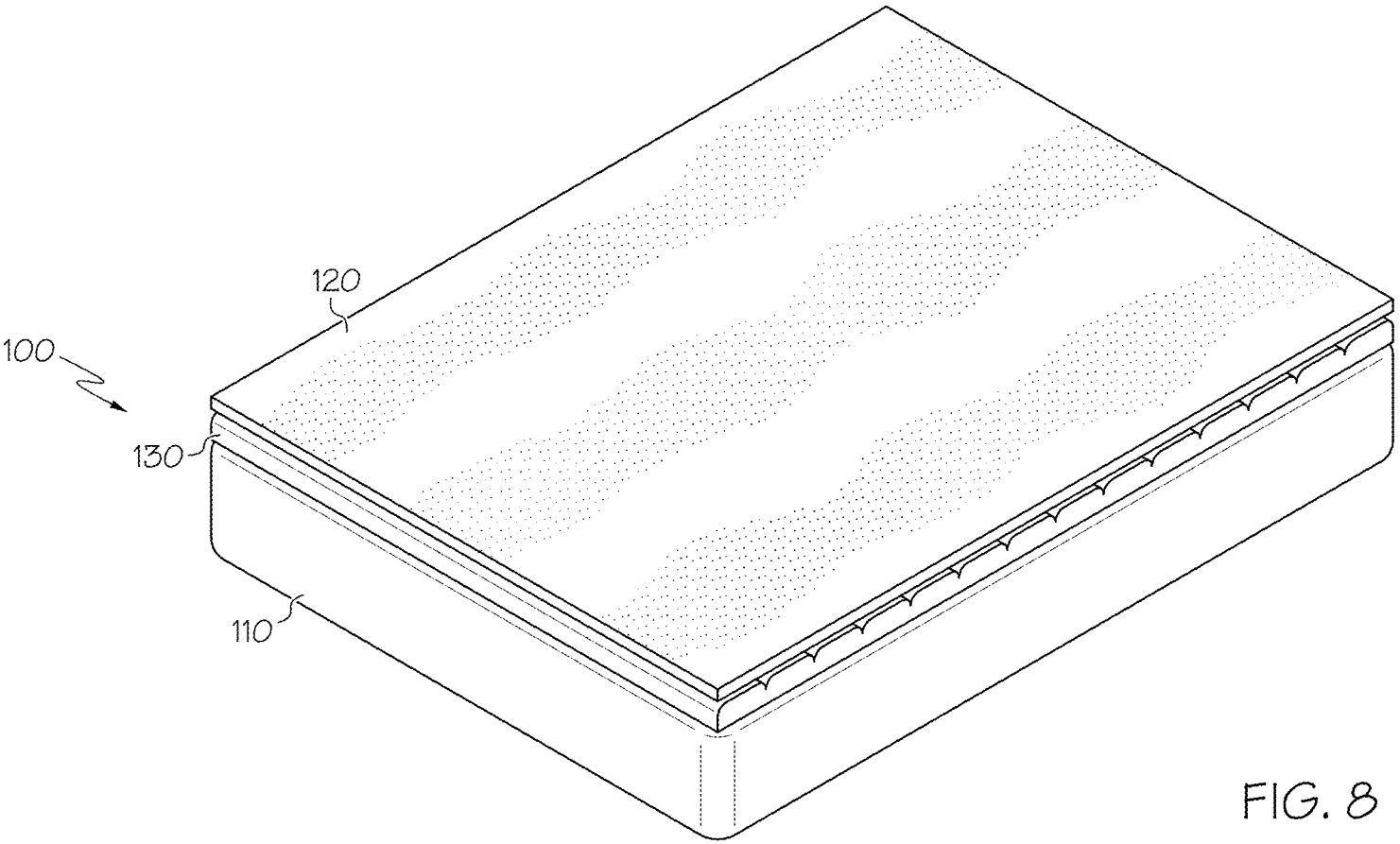
FIG. 8 shows one embodiment of a multilayered mattress having a top gel infused foam layer disposed over a channeled foam layer with horizontal channels according to one or more embodiments.

FIG. 8 shows one embodiment of a mattress system 100. The mattress system 100 may include at least two foam layers placed directly on top of a mattress base 110. The top foam layer 120 may be made from gel infused high density foam. Alternatively, the top foam layer 120 may comprise latex foam, or memory foam. The lower foam layer 130 is made from channeled foam, for example, channeled polyurethane foam. The gel infused layer 120, latex foam, and/or memory foam may be placed directly on top of the channeled foam layer 130, which is placed directly on top of the mattress base 110. Additionally, it is contemplated to stack two or more channeled or modular foam layers 130 on top of one another.

Figure 9:
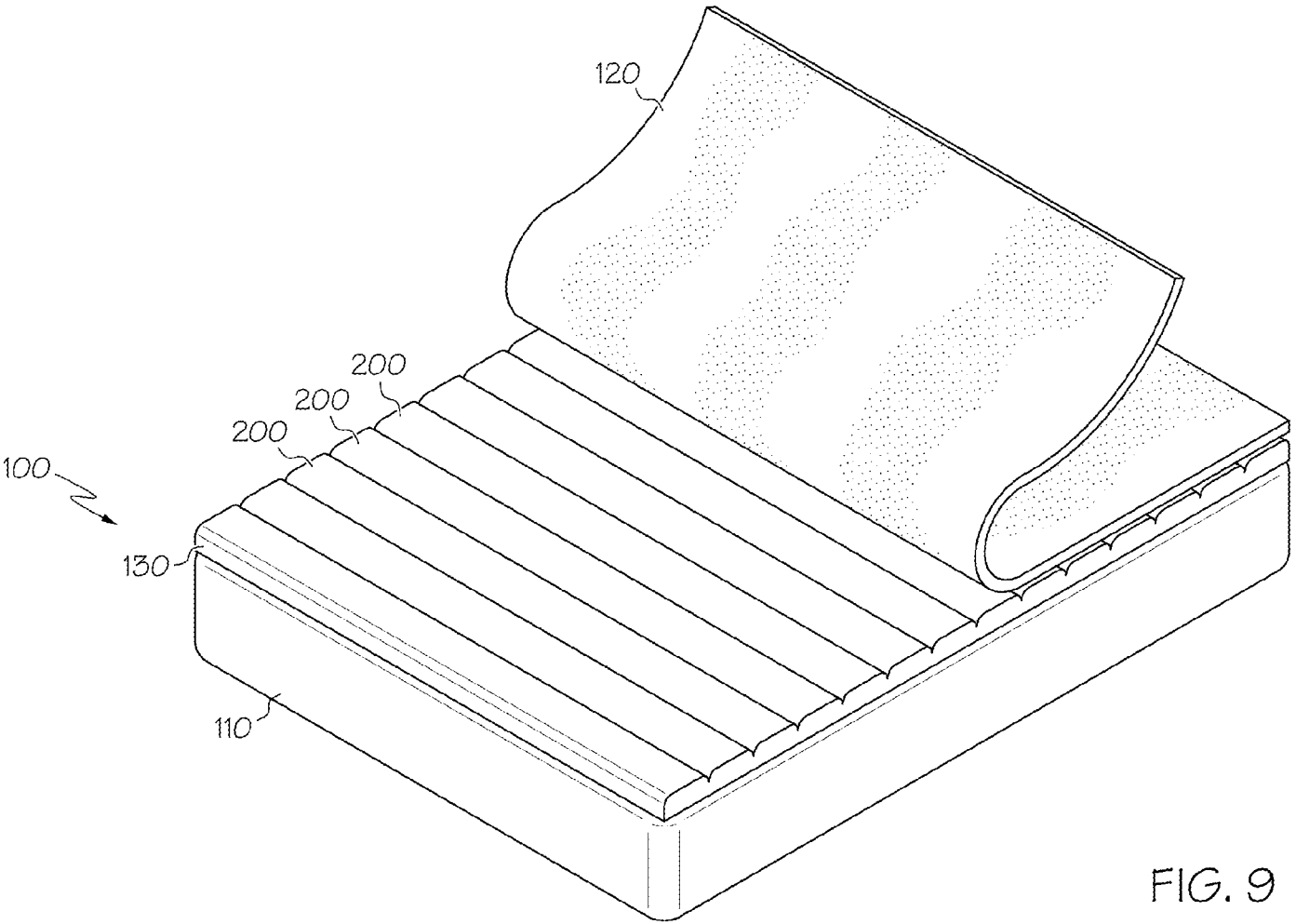
FIG. 9 shows the multilayered mattress of FIG. 8 with a top gel infused foam layer pulled back exposing a channeled foam layer with horizontal channels according to one or more embodiments.

Reference is now with respect to FIG. 9, which shows the multilayered mattress of FIG. 1 with a top gel infused foam layer 120 pulled back exposing a channeled foam layer 130. The channeled foam layer 130 has transverse convoluted channels 200 that are uniform in dimension and extend a width of the foam layer 130. The channels 200 are longitudinally spaced equidistance apart from one another along a length of the intermediate foam layer 130. In other words, the channeled foam layer 130 has a series of channels 200 extending from side to side, which are present along the entire length from head to toe of the channeled foam layer 130. The uniform distribution provides an even distribution of support not achieved by other shaped layers which have a "zoned" configuration made from channels of different sizes and shapes. In a preferred embodiment, the channels 200 are so dimensioned as to form an upside down "U" shape, when placed in the configuration shown in FIGS. 1 and 2. Additionally, the channels aid in air flow.

Figure 17:
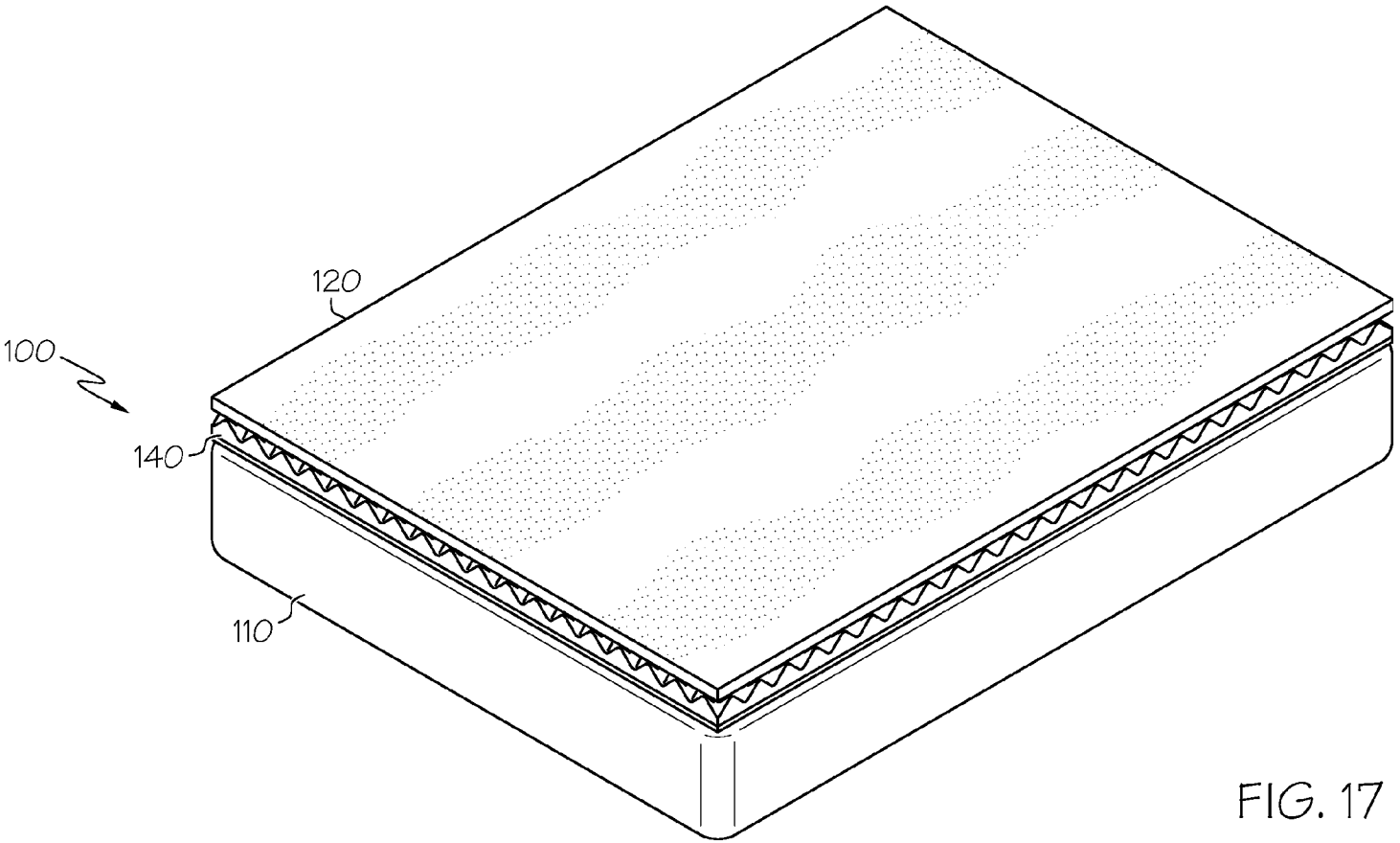
FIG. 17 is a perspective view depicting a multilayered mattress having a top gel infused foam layer disposed over a convoluted foam layer.

Another embodiment of a mattress system 100, as shown in FIG. 17, incorporates the gel infused form layer 120 over convoluted foam layer 140. The mattress system 100 may include at least two foam layers placed directly on top of a mattress base 110. The top foam layer 120 may be made from gel infused high density foam. The lower foam layer 140 is made from convoluted foam, for example, convoluted polyurethane foam. The gel infused layer 120, latex foam, and/or memory foam may be placed directly on top of the convoluted foam layer 140, which is placed directly on top of the mattress base 110. Additionally, it is contemplated to stack two or more convoluted foam layers 140 on top of one another.

Figure 11A:
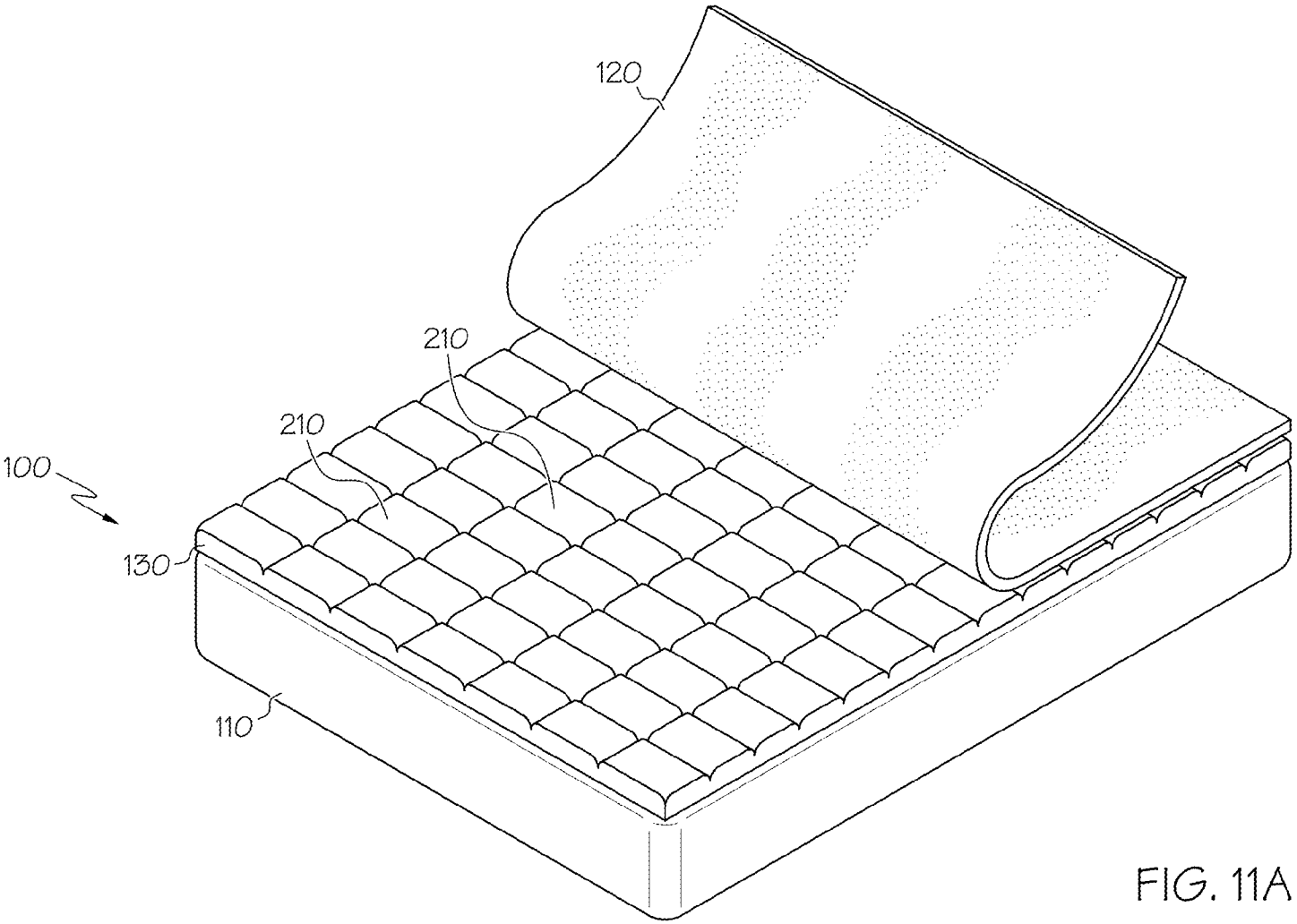
FIG. 11A shows the multilayered mattress of FIG. 8 with a top gel infused foam layer pulled back exposing a channeled foam layer with square support sections according to one or more embodiments.

While FIG. 2 shows horizontal channels, it is also contemplated that the channeled foam layer 130 includes vertical channels 250 (See FIG. 11C), square sections 210 (See FIG. 11A) formed by intersecting horizontal and vertical channels, and combinations thereof. These square sections 210 are depicted in FIG. 11A. This type of foam layer may also be referred to as a modular foam layer, wherein each square section 210 is considered a module. Without being bound by theory, these square sections 210 are believed to provide superior support and reduction of pressure points.

Figure 11B:
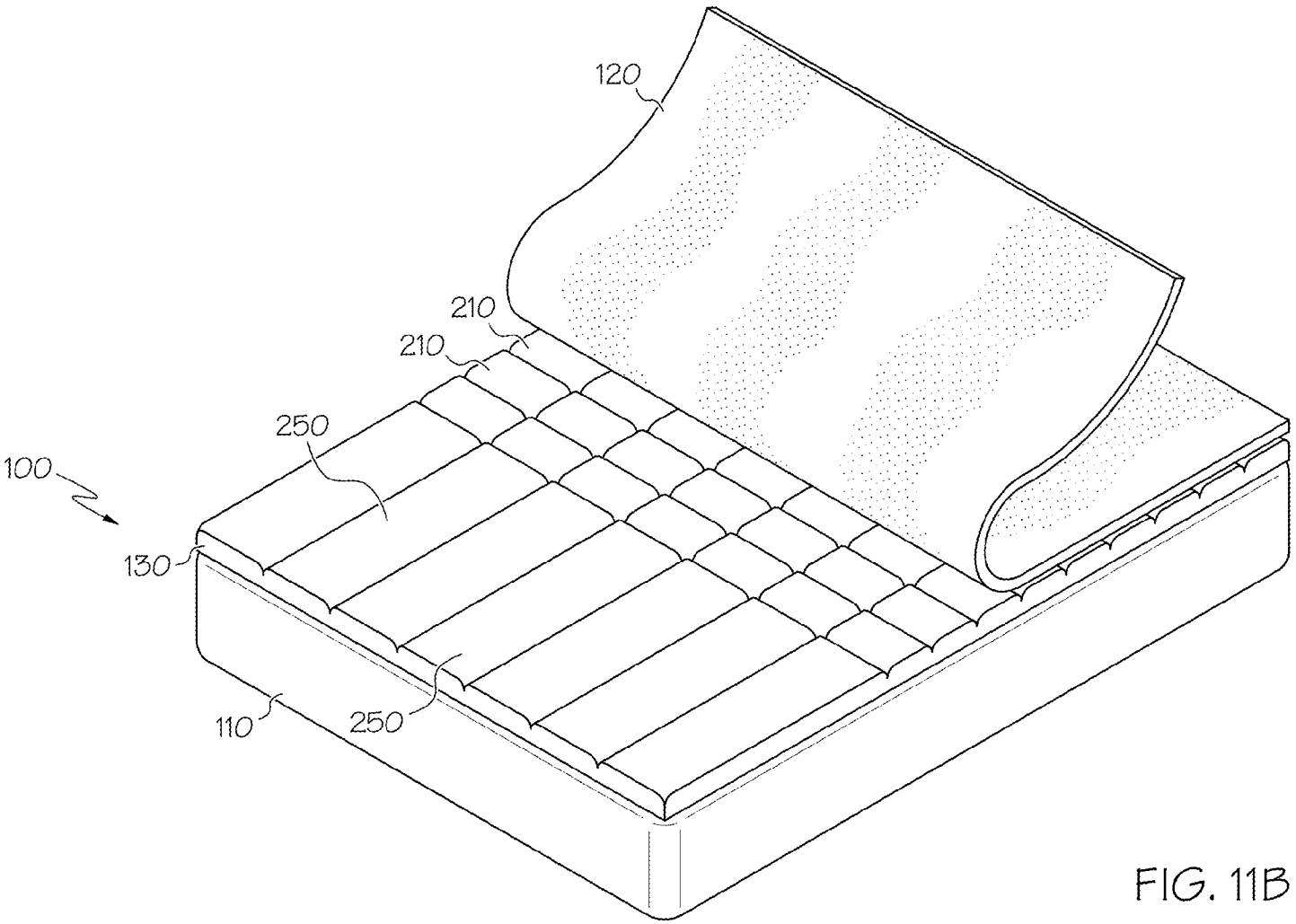
FIG. 11B shows the multilayered mattress of FIG. 8 with a top gel infused foam layer pulled back exposing a channeled foam layer with square support sections and vertical channels according to one or more embodiments.
Figure 11C:
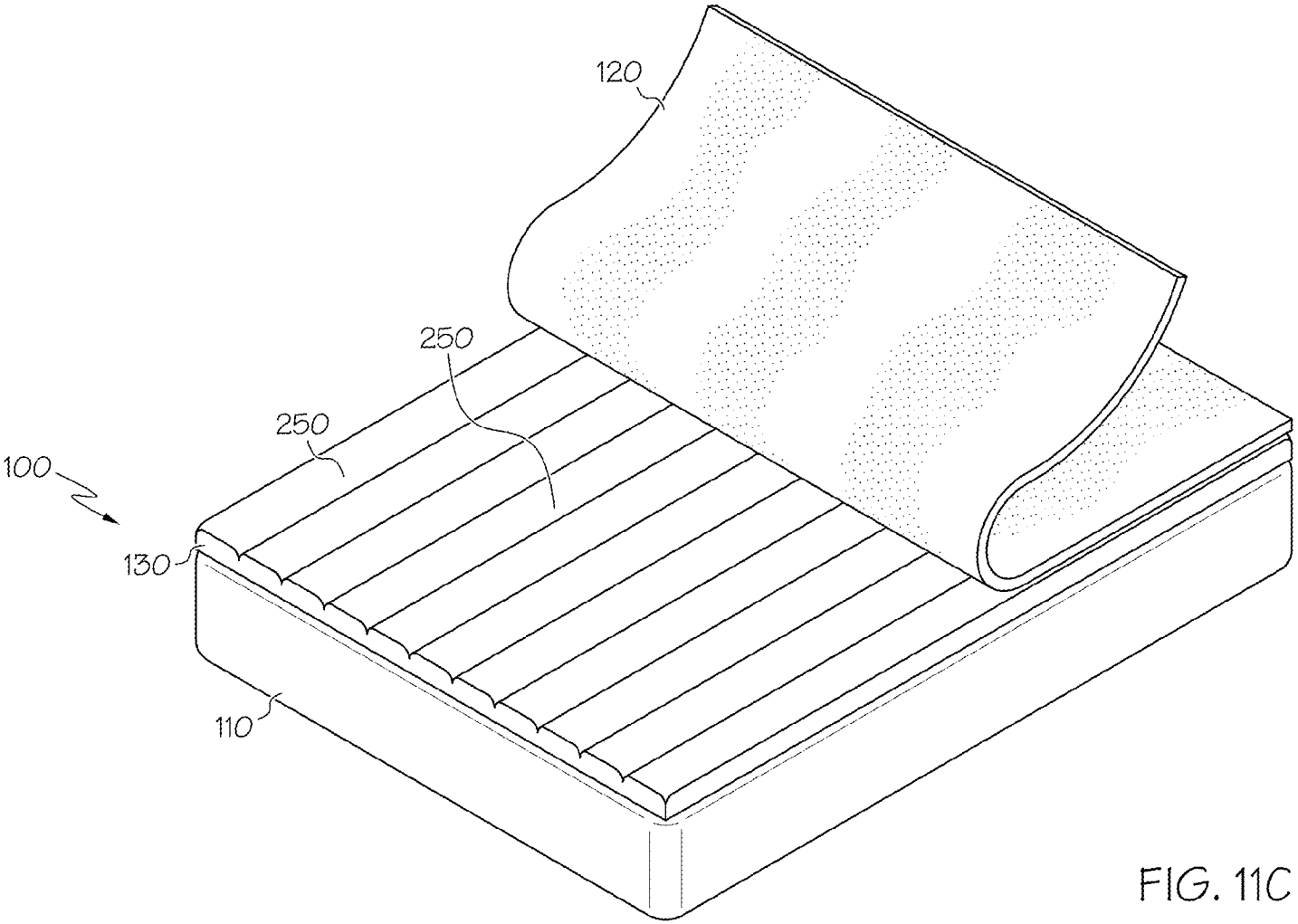
FIG. 11C shows the multilayered mattress of FIG. 8 with a top gel infused foam layer pulled back exposing a channeled foam layer with vertical channels according to one or more embodiments.

Alternatively as shown in FIG. 11B, the channeled foam layer 130 may include vertical channels 250 in at least a section of the channeled foam layer 130. Further as shown, the channeled foam layer 130 may also include square sections 210 adjacent the section with vertical channels 250. Without being bound by theory, this variable profile in the channeled foam layer 130 shown in FIG. 11B may be a good way to tailor different properties into the mattress.

Figure 11D:
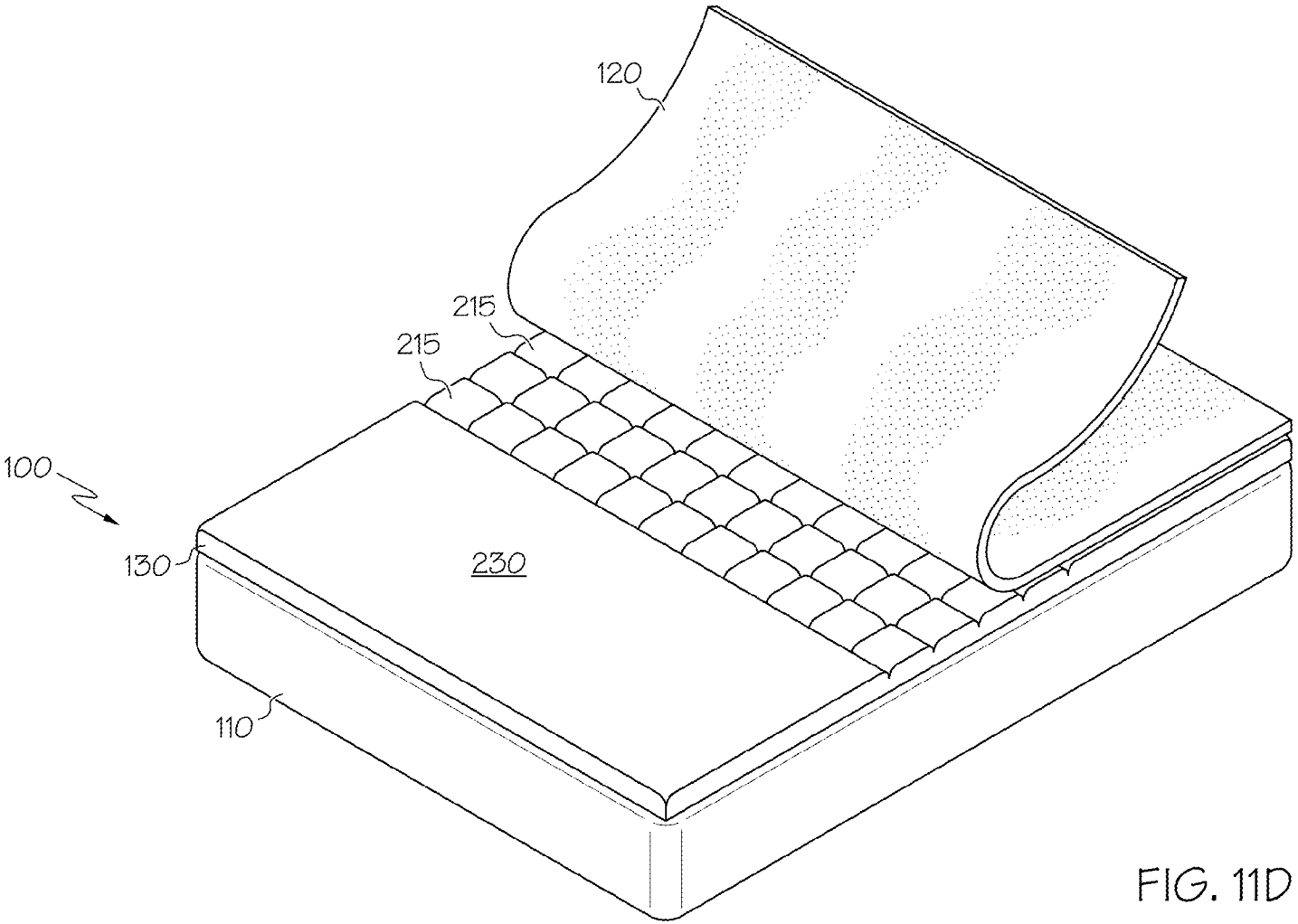
FIG. 11D shows the multilayered mattress of FIG. 8 with a top gel infused foam layer pulled back exposing a foam layer with square support sections and an unchanneled section according to one or more embodiments.
Figure 11E:
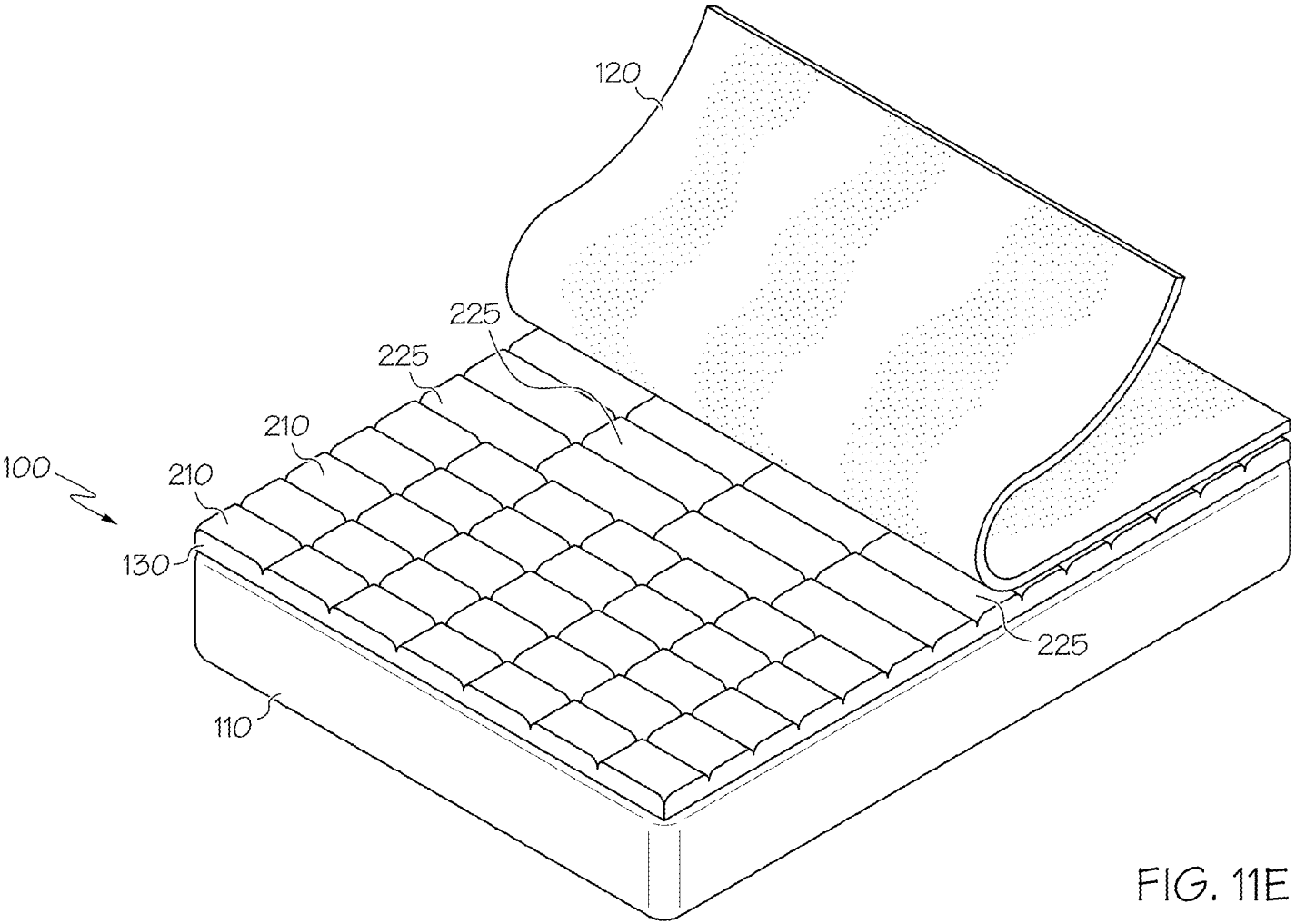
FIG. 11E shows the multilayered mattress of FIG. 8 with a top gel infused foam layer pulled back exposing a channeled foam layer with two types of square support sections according to one or more embodiments.
Figure 11F:
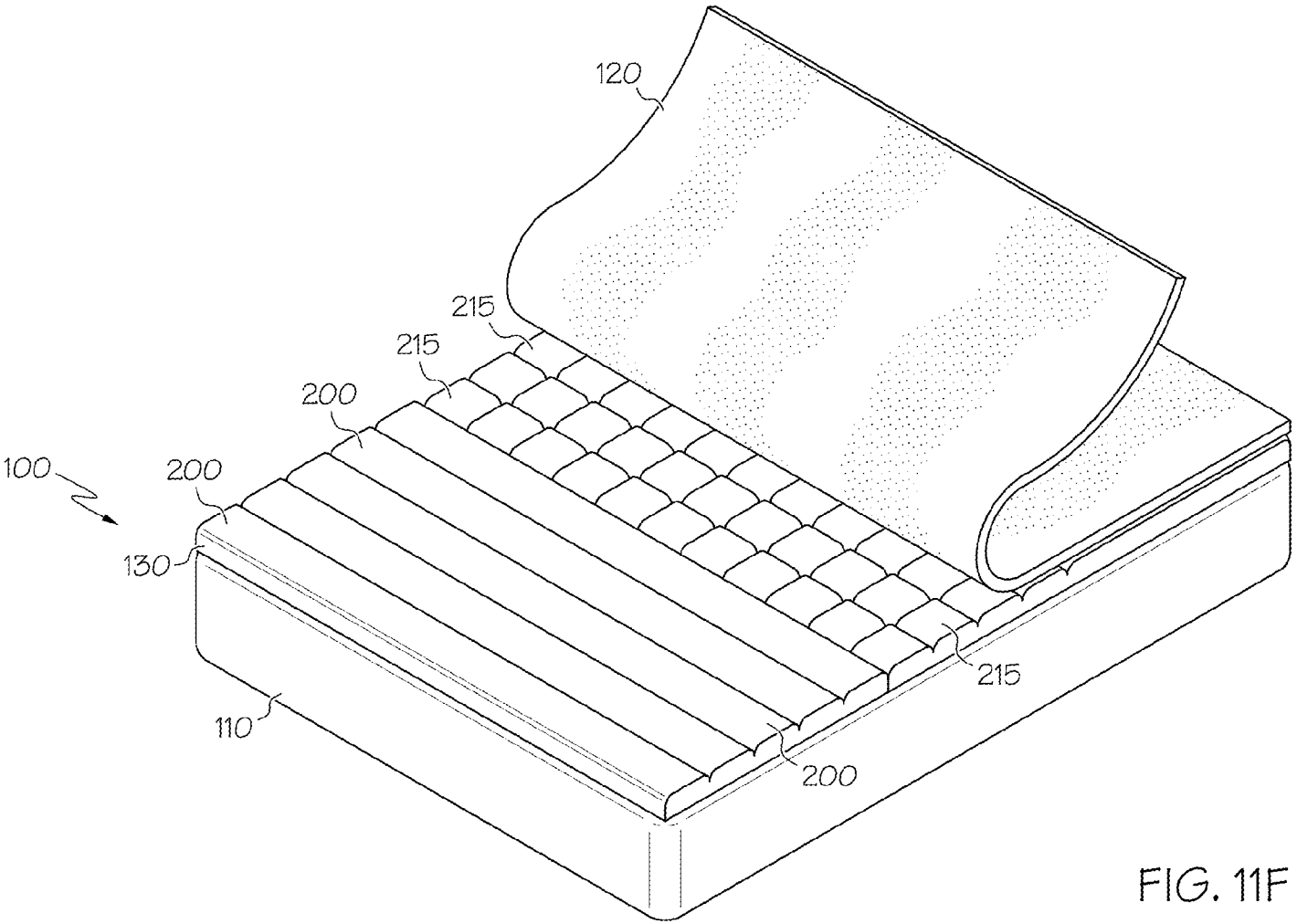
FIG. 11F shows the multilayered mattress of FIG. 8 with a top gel infused foam layer pulled back exposing a channeled foam layer with a horizontal channel section and a square support section according to one or more embodiments.

Similarly, the FIG. 11D mattress may have a portion with square sections 210 and a portion without channels 230. Alternatively as show in FIG. 11E there may be a combination of different square sections 210, 225. For example, it may be desirable to have sections with smaller square section profiles 210, which provide greater support and firmness, in combination with larger square sections 225, which provide less firmness. Again, it provides tailorability of mattress properties. Further as shown in FIG. 11F, the channeled foam layer 130 may include horizontal channels 200 in combination with square sections 210.

The channeled foam layer 130 may have a depth of up to 6 inches, or 2-4 inches, or about 2 inches. Referring to FIG. 9, the horizontal channels 200 are about 3-6 inches, or about 4-5 inches in width and are separated by vertical spaces that do not extend all the way through the depth of the foam layer 130. Referring to FIG. 11A, the square sections 210 of the modular foam layer may include a length of about 3-6 inches, or about 4-5 inches, and similarly the square sections 210 may include a width of about 3-6 inches, or about 4-5 inches. As shown in FIG. 11E, lengths of square sections are variable.

Referring to FIG. 9, the channeled foam layer 130 is preferably positioned such that the channeled side of the channeled foam layer 130 is in contact with the layer above it, for example, a top gel infused high density foam layer 120, a latex foam layer, or a memory foam layer. Thus, preferably, the planar side of the channeled foam layer 130 is in direct contact with the mattress base 110. In other embodiments, the channeled foam layer 130 is positioned such that the planar side is in direct contact with the gel infused high density foam layer 120 and the channeled side of the channeled foam layer 130 is in direct contact with the mattress base 110.

While various compositions are contemplated, the channeled foam layer 130 is made preferably of high density polyurethane foam. Firmness of mattress components is typically measured in terms of density, expressed in pounds per cubic foot (PCF) or its deflection characteristic, expressed as indentation load deflection (ILD). For several of the embodiments disclosed herein, the channeled foam layer 130 comprises 1.0 to 2.0 PCF polyurethane foam having an ILD characteristic of 20 to 30. In a preferred embodiment the channeled foam layer 130 comprises 1.8 PCF polyurethane foam having an ILD characteristic of approximately 24.

The mattress base 110 can be any suitable supporting apparatus. For example, the support base is a premium innerspring unit, which comprises spring coils interconnected in a conventional manner. In another embodiment, the support base comprises high density foam. For example, and not by way of limitation, the high density foam may comprises 1.0 to 2.0 PCF polyurethane foam having an ILD characteristic of 20 to 30, or alternatively 1.8 PCF polyurethane foam having an ILD characteristic of approximately 24.

The mattress base 110 can also be comprised of other suitable support structures used in a conventional fashion such as wood planks coupled to a frame and air, gel or water filled bladders. Embodiments employing filled bladders preferably have bladders that are permanently filled so as to not require the use of expensive motors and electronics and thus reduce cost. In one embodiment, the support base is covered in suitable fabric material in a conventional way.

Figure 10:
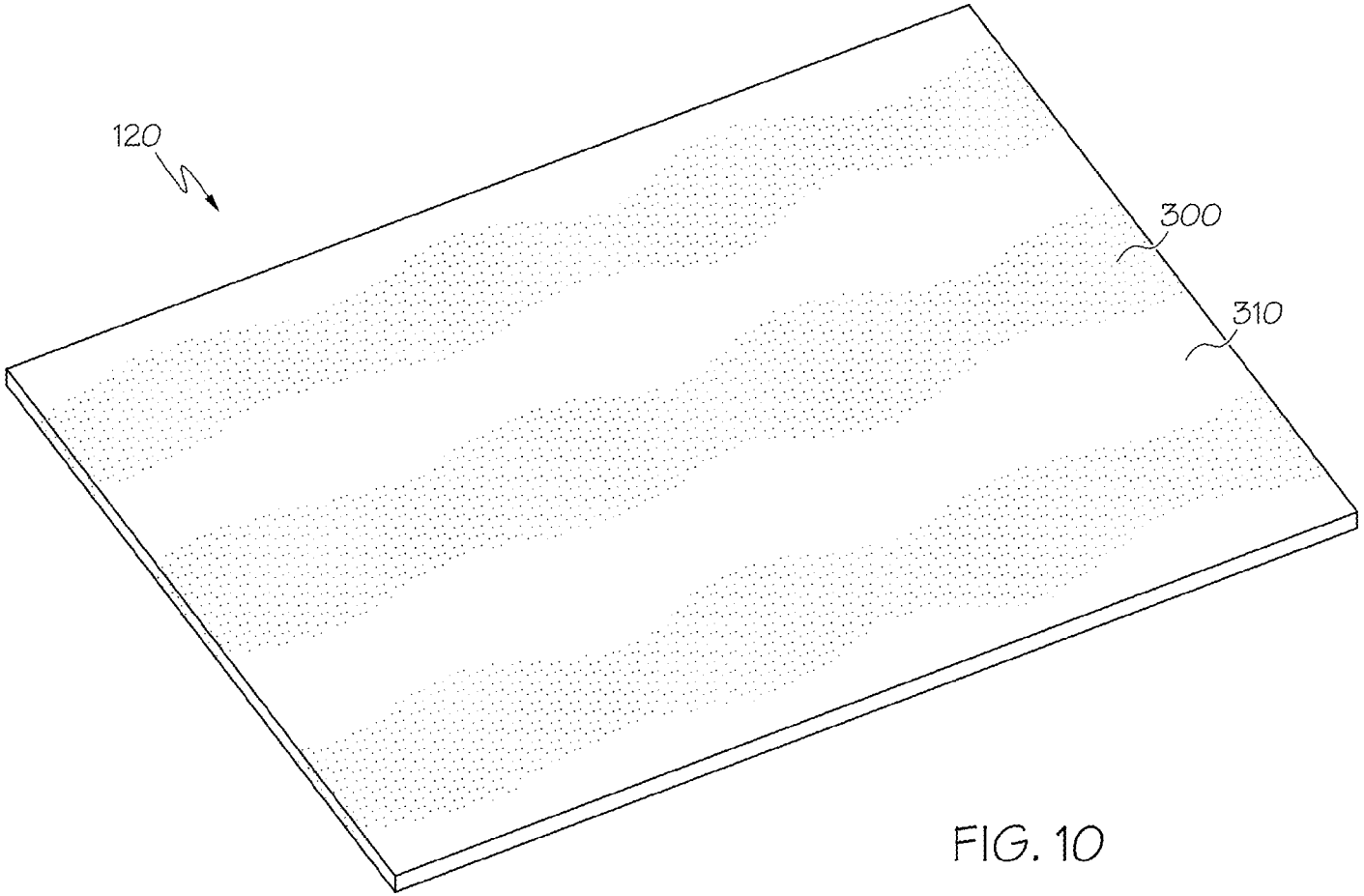
FIG. 10 shows a detailed view of one embodiment of the gel infused foam layer according to one or more embodiments.

With the aspects described in relation to FIGS. 8 and 9 in mind, attention is turned to FIG. 10, which shows a detailed view of one embodiment of the gel infused foam layer 120. The gel in thermo-regulating gel layer 150 may be the same or a different composition from the gel infused high density foam layer 120. The top gel infused high density foam layer 120 may comprise a non-particulate gel 300 heterogeneously distributed within a high density polyurethane foam 310. Preferably, the gel is polyurethane but can be any suitable non-particulate gel. Importantly, the high density polyurethane foam 310 is effectively free of any visco-elastic foam. In other words, the gel-infused foam layer 120 does not contain any form of visco-elastic or memory foam.

Without being bound by theory, the use of polyurethane as a component of the gel infused foam layer 120 results in significantly more economical gel-foam hybrid layer than realized by other hybrid gel-foam layers currently available. Suffice it to say that all the advantages of a gel-memory foam hybrid layer can be achieved more economically in the disclosed embodiments. The density of the polyurethane foam in the gel infused layer 120 is less than the polyurethane foam comprising the channeled foam layer 130 and can range from approximately 0.9 to approximately 1.9 PCF. Similarly, the ILD characteristic of the polyurethane for the gel infused layer is less than the foam comprising the channeled foam layer 130 and can range from approximately 1 to 10. In one embodiment, the gel infused layer comprises 1.5 PCF polyurethane foam with an ILD characteristic of approximately 5. Polyurethane gel layers are advantageous, because they exhibit a relatively high thermal conductivity as well as provide effective support, pressure relief and comfort.

Moreover, without being bound by theory, a homogeneous distribution of particulates, does not allow for different regions of firmness, which may be particularly desirable by consumers who share a mattress but prefer different mattress firmness. However, the present heterogeneous distribution of gel results in a fully customizable configuration with improved pressure distribution management and thermal regulation.

Figure 12:
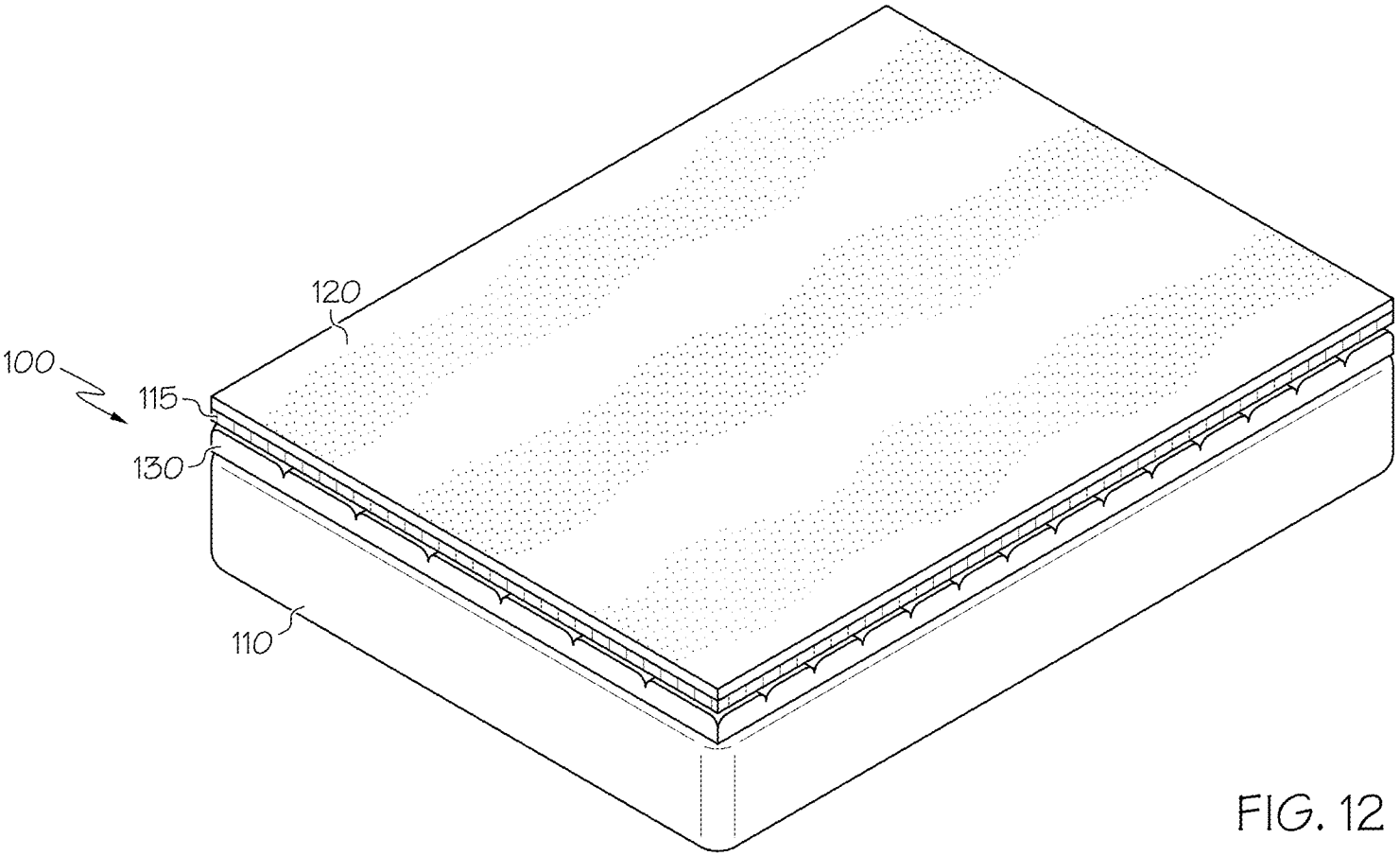
FIG. 12 shows another embodiment of a multilayered mattress having a visco-elastic memory foam layer disposed between a top gel infused foam layer and a channeled foam layer with horizontal channels according to one or more embodiments.
Figure 13:
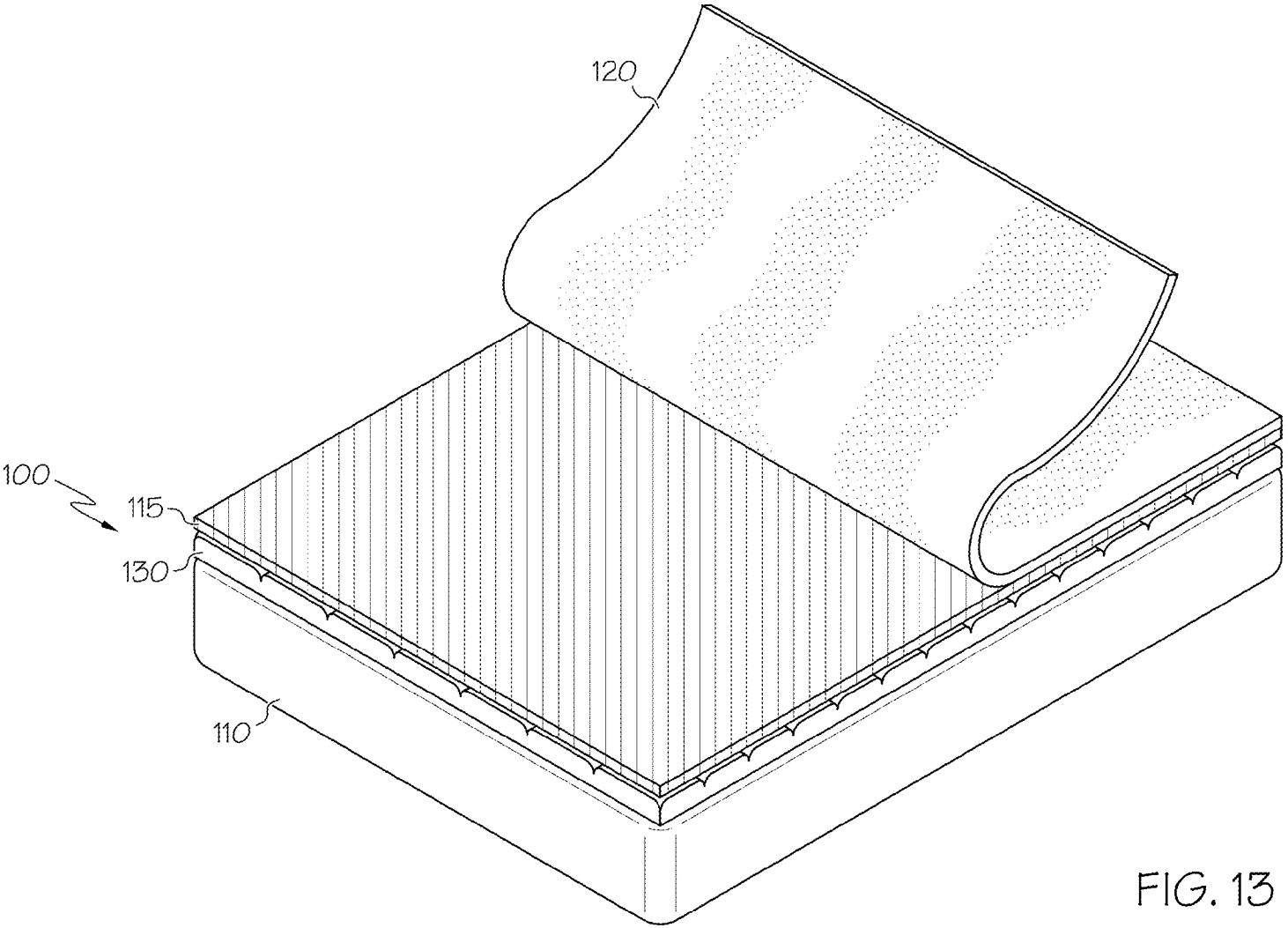
FIG. 13 shows the multilayered mattress of FIG. 8 with a top gel infused foam layer pulled back exposing a visco-elastic memory foam layer over a channeled foam layer with horizontal channels according to one or more embodiments.
Figure 14:
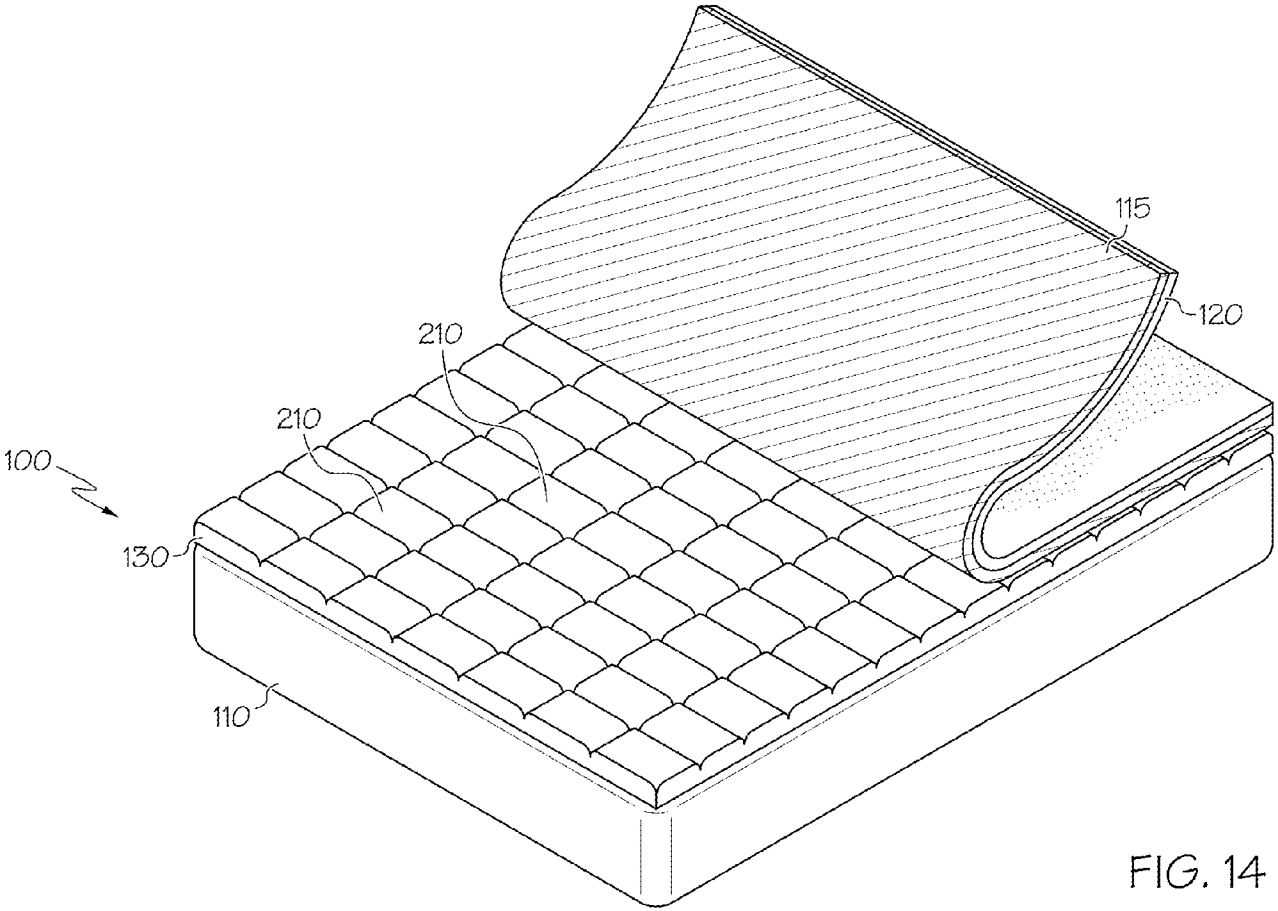
FIG. 14 shows a multilayered mattress with a top gel infused foam layer and a visco-elastic memory foam layer pulled back exposing a channeled foam layer with square support sections according to one or more embodiments.

Referring now to FIGS. 12-14, it is also contemplated to also use a visco-elastic memory foam layer 115 disposed between the channeled foam layer 130 and the gel infused foam layer 120. This combination is beneficial because it capitalizes on the advantages of gel and visco-elastic foam, i.e., thermal regulation and pressure regulation. Alternatively, it is contemplated to use visco-elastic memory foam directly on the channeled foam layer 130 by itself. The visco-elastic memory foam may be conventional memory foam, gel infused memory foam, latex infused memory foam, or combinations thereof. While not shown in the embodiments of FIGS. 12-14, any of the channeled foam layer 130 embodiments of FIGS. 11A-11F as well as many contemplated variations are applicable to the memory foam designs of FIGS. 12-14.

Figure 15:
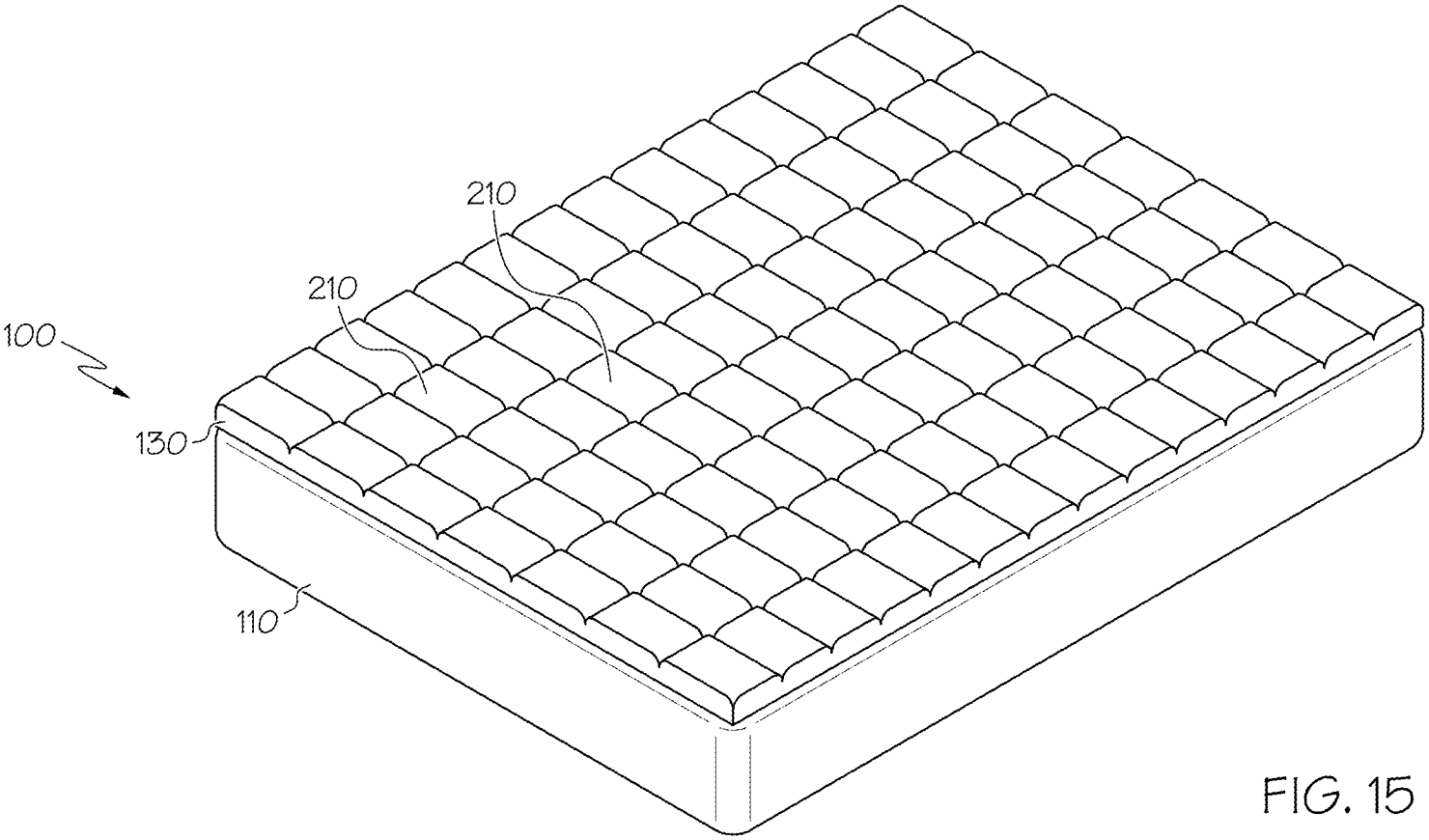
FIG. 15 shows a multilayered mattress with a modular foam layer with square support sections according to one or more embodiments.

Alternatively, it is contemplated that the mattress system 100 may include a modular or channeled foam layer 130 without the need for additional gel infused foam or memory foam layers as shown in FIG. 15. The modules 210 act like foam coils and provide many benefits, such as air circulation, the reduction of motion transfer, as well as contouring to the body. Additionally, this mattress helps greatly reduce pressure points to the sleeping person, whether used on its own, or with gel infused foam, memory foam, latex, or simply a plush quilt using soft foam.

Figure 16A:
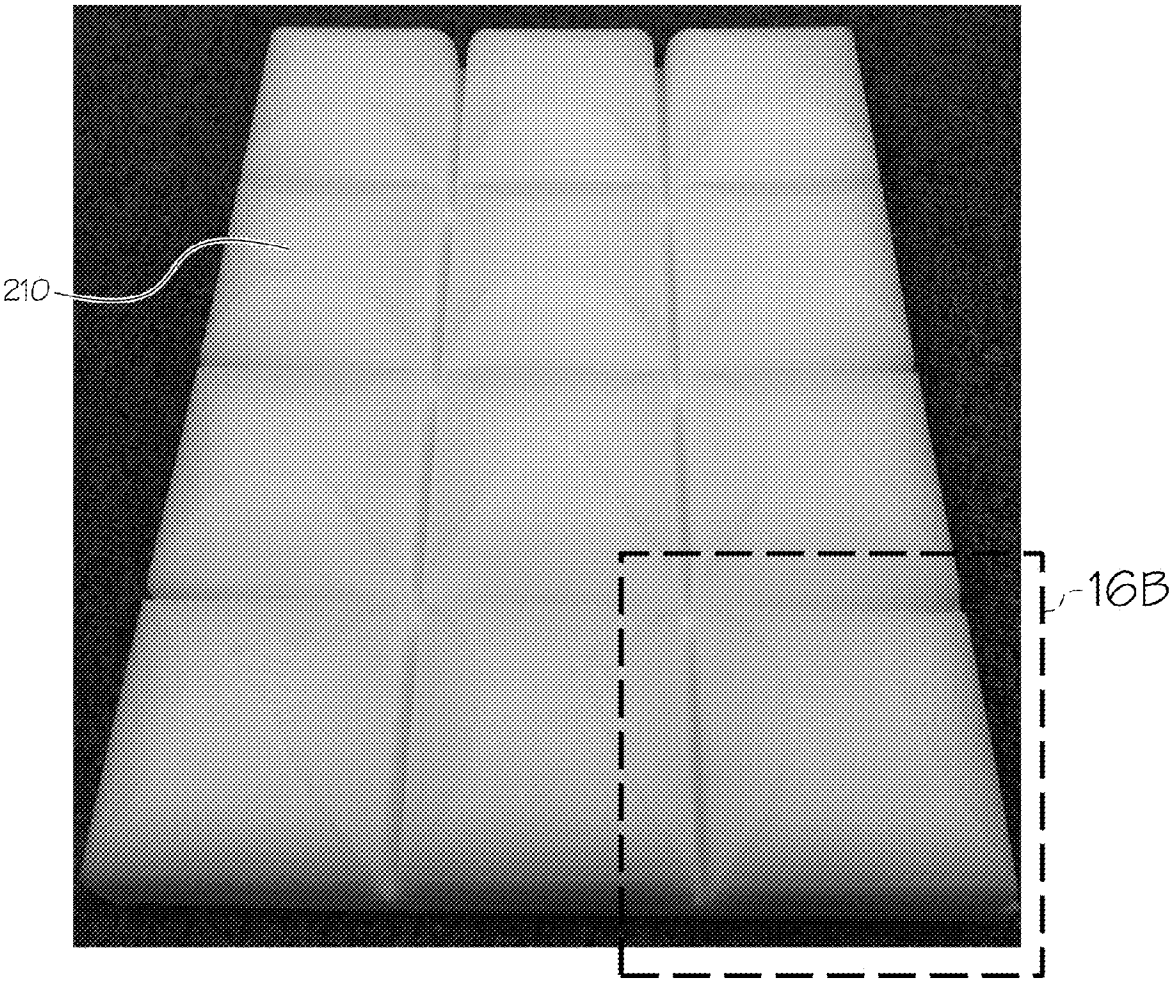
FIG. 16A shows a multilayered mattress with a modular foam layer with square support sections according to one or more embodiments.
Figure 16B:
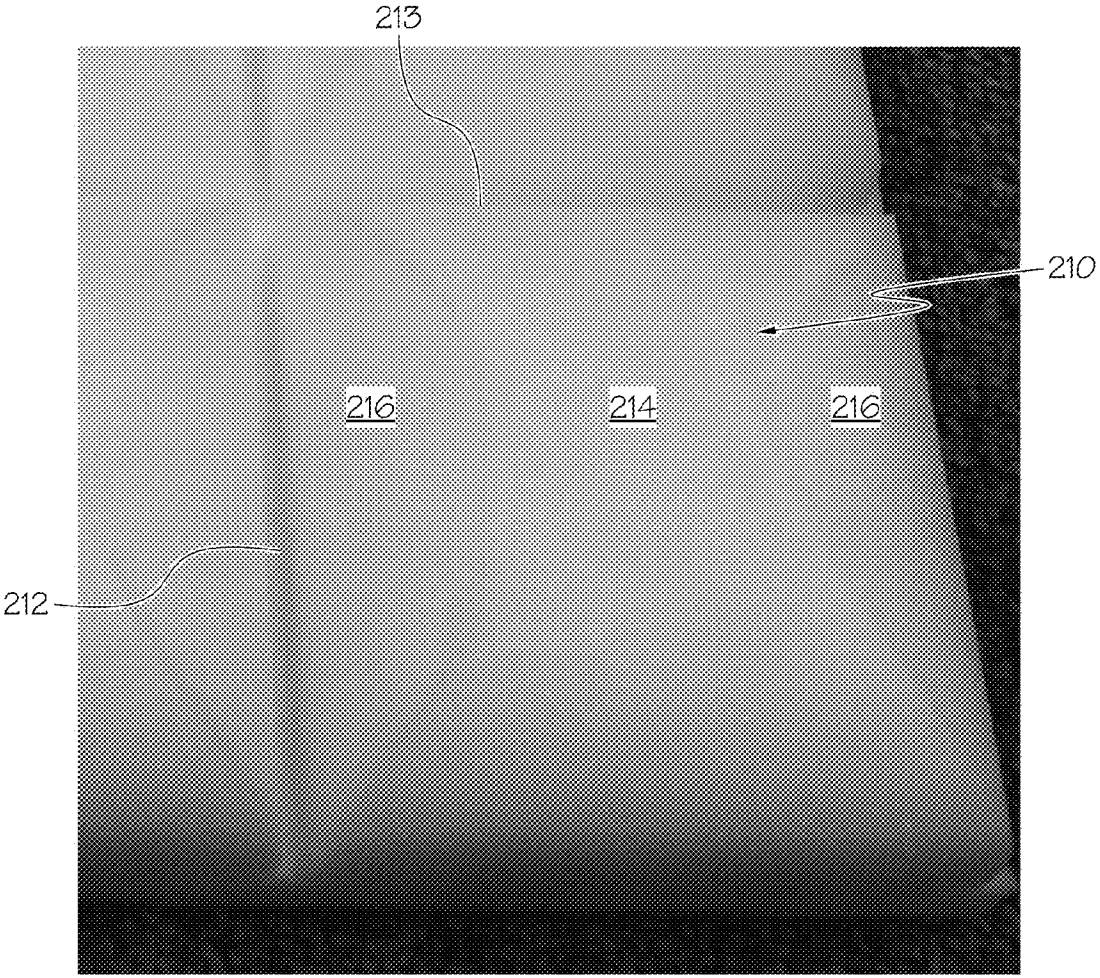
FIG. 16B is a close-up view of the square support sections of FIG. 16A according to one or more embodiments.

The modules may include various geometries. Referring to FIGS. 16A and 16B, the modules 210 may be separated from each other by vertical channels 212 and horizontal channels 213. Various channel spacings are contemplated herein; however, minimizing the spacing may decrease the support or "coil effect" produced by the modules. Additionally, the module 210 shaping may vary, and the embodiments herein should not be limited based on geometry. In the exemplary embodiment of FIG. 16B, the module 210 may include side curved sections 216 and upper raised sections 214 as shown.

As stated above, latex foam may also be used on top of the channeled or modular foam. With the latex foam, varying firmness levels may be achieved. Moreover, it is also contemplated to merely include a quilted cover over the modular foam comprised of foam and fiber.

It is noted that terms like "preferably", "generally", "commonly" and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present disclosure.

While the present disclosure has been particularly shown and described with reference to specific embodiments, it should be understood by those skilled in the art that various changes in form and detail may be made therein without departing from the spirit and scope of the disclosure as defined by the appended claims.

What is claimed is:

1. A mattress system comprising:

a mattress base;

a support layer disposed over the mattress base;

a multifunctional foam layer having a substantially planar bottom side and a non-planar top side, the bottom side contacting a top side of the support layer, wherein the non-planar top side of the multifunctional foam layer defines a convoluted profile, a channeled profile, or combinations thereof; and at least one gel infused foam layer disposed over the non-planar top side of the multifunctional foam layer, the gel infused foam layer further comprising a heterogeneous mixture of gel and polyurethane foam, the gel infused foam layer being substantially free of visco-elastic memory foam, wherein least one air passage is present in spacing formed between the non-planar top side of the multifunctional foam layer and the at least one gel infused foam layer.

2. The mattress system of claim 1 wherein the mattress base comprises one or more support members selected from the group consisting of high density foam, springs, filled bladders, coils, wood slats, and combinations thereof.

3. The mattress system of claim 1 wherein the support layer, the multifunctional foam layer, or both comprise latex foam, polyurethane foam, visco-elastic memory foam, or combinations thereof.

4. The mattress system of claim 1 wherein the gel infused foam layer comprises approximately 0.9 to approximately 2.0 pounds per cubic foot (PCF) polyurethane foam having an indentation load deflection (ILD) characteristic of approximately 1 to approximately 10.

5. A mattress system of claim 1 wherein the gel comprises polyurethane gel.

6. A mattress system of claim 1 wherein the multifunctional foam layer comprises a channeled profile, wherein the channeled profile includes horizontal channels, vertical channels, square sections formed by intersecting horizontal and vertical channels, or combinations thereof.

7. A mattress system of claim 6 wherein the channeled profile comprises horizontal channels.

8. A mattress system of claim 6 wherein the channeled profile comprises horizontal channels.

9. A mattress system of claim 1 wherein the multifunctional foam layer comprises a convoluted profile.

10. A mattress system comprising:

a mattress base;

a multifunctional foam layer having a substantially planar bottom side overlying the mattress base, and a non-planar top side, wherein the non-planar top side of the multifunctional foam layer defines a convoluted profile, a channeled profile, or combinations thereof;

at least one gel infused foam layer disposed over the multifunctional foam layer, the gel infused foam layer further comprising a heterogeneous mixture of gel and polyurethane foam, the gel infused foam layer being substantially free of visco-elastic memory foam.

11. The mattress system of claim 10 wherein the gel infused foam layer directly overlies the multifunctional foam layer.

12. The mattress system of claim 10 further comprising a visco-elastic memory foam layer directly overlying the multifunctional foam layer.

13. A mattress system of claim 10 wherein the non-planar top side of the multifunctional foam layer is in direct contact with the gel infused foam layer and the planar bottom side is in direct contact with the mattress base.

14. The mattress system of claim 10 wherein the gel infused foam layer comprises approximately 0.9 to approximately 2.0 pounds per cubic foot (PCF) polyurethane foam having an indentation load deflection (ILD) characteristic of approximately 1 to approximately 10.

15. A mattress system of claim 10 wherein the gel comprises polyurethane gel.

16. The mattress system of claim 10 wherein the mattress system comprises a thermo-regulating gel layer overlying the gel infused foam layer, wherein the thermo-regulating gel layer comprises an aqueous polymeric gel.

17. The mattress system of claim 10 wherein the mattress base comprises one or more support members selected from the group consisting of high density foam, springs, filled bladders, coils, wood slats, and combinations thereof.

18. A mattress system of claim 10 wherein the multifunctional foam layer comprises a channeled profile, wherein the channeled profile includes horizontal channels, vertical channels, square sections formed by intersecting horizontal and vertical channels, or combinations thereof.

19. A mattress system of claim 10 wherein the multifunctional foam layer comprises a convoluted profile.

* * * * *